United States Patent [19]

Sampei et al.

[11] Patent Number: 4,766,058

[45] Date of Patent: Aug. 23, 1988

[54] SILVER HALIDE PHOTOGRAPHIC MATERIAL WITH A SPECIFIED SILVER DENSITY AND DRY THICKNESS

[75] Inventors: Takeshi Sampei; Toshifumi Iijima; Yoshitaka Yamada; Hiroshi Shimazaki; Kenji Kumashiro; Yoshiharu Mochizuki; Syoji Matsuzaka; Hiroshi Kashiwagi, all of Hiho, Japan

[73] Assignee: Konishiroku Photo Industry Co., Ltd., Tokyo, Japan

[21] Appl. No.: 886,552

[22] Filed: Jul. 16, 1986

[30] Foreign Application Priority Data

| | | | |
|---|---|---|---|
| Jul. 17, 1985 | [JP] | Japan | 60-157198 |
| Aug. 9, 1985 | [JP] | Japan | 60-175374 |
| Aug. 16, 1985 | [JP] | Japan | 60-180271 |

[51] Int. Cl.[4] ..... G03C 5/24; G03C 1/08; G03C 7/32; G03C 1/02

[52] U.S. Cl. ..... 430/496; 430/486; 430/489; 430/502; 430/556; 430/557; 430/564; 430/567

[58] Field of Search ..... 430/496, 564, 567, 551, 430/486, 489, 556, 557; 431/502

[56] References Cited

U.S. PATENT DOCUMENTS

| | | | |
|---|---|---|---|
| 3,361,565 | 1/1968 | Umberger | 430/496 |
| 4,312,941 | 1/1982 | Scharf et al. | 430/510 |
| 4,444,865 | 4/1984 | Silverman et al. | 430/605 X |
| 4,447,523 | 5/1984 | Ross et al. | 430/551 X |

FOREIGN PATENT DOCUMENTS

| | | |
|---|---|---|
| 0660009 | 4/1979 | U.S.S.R. . |

*Primary Examiner*—Mukund J. Shah
*Attorney, Agent, or Firm*—Jordan B. Bierman

[57] ABSTRACT

A photographic material comprising at least one blue sensitive silver halide emulsion layer is disclosed. The silver density of the emulsion layer is not less than $4.0\times10^{-1}$ g/cm$^3$ and the dry thickness of the layer is not more than 4.0 μm. A core/shell type silver halide emulsion and a high-speed reaction type scavenger for the oxidation products of a developing agent are preferably used for the emulsion layer. The photographic material has a high sensitivity and provides an image having a superior sharpness and resolution.

17 Claims, No Drawings

SILVER HALIDE PHOTOGRAPHIC MATERIAL WITH A SPECIFIED SILVER DENSITY AND DRY THICKNESS

BACKGROUND OF THE INVENTION

The present invention relates to a silver halide photographic material.

Silver halide color photographic materials, particularly silver halide photographic materials for photographing use, has always been desired to be highly sensitive and excellent in the image quality. Particularly, with the recent popularlization of portable miniature cameras in the photographic field, even a small-size negative has become demanded to give an image comparable in the quality with that from a large-size negative. So to speak, there has been a strong demand for the development of a silver halide color photographic material whose resolution as well as sharpness is not degraded even in a large magnification.

Various techniques have been conventionally known for improving the sharpness. One of the techniques is for the improvement of the edge effect, and another is for the prevention of light scattering. Examples of the edge effect improving technique include the method using an unsharp mask in the printing field and the method using a DIR coupler for color negative film. Of these the method using an unsharp mask has its limit of practical use because its process is complex. There are many known methods using DIR couplers; useful examples of the DIR coupler include those compounds as described in Japanese Patent Examined Publication Nos. 34933/1980, Japanese Patent Publication Open to Public Inspection (hereinafter referred to as Japanese Patent O.P.I. Publication) No. 93344/1982, U.S. Pat. Nos. 3,227,554, 3,615,506, 3,617,291, 3,701,783, and the like. However, where a DIR coupler is used to stress the edge effect, the MTF (modulation transfer function), although it is improved in a lower-frequency region, cannot be expected to be improved in a higher-frequency region required necessary for a high magnification, and is accompanied by an adverse side effect such as the deterioration of sensitivity or of density. If a DIR coupler capable of extending its affect away such as a diffusible DIR or timing DIR coupler is used, the deterioration of sensitivity or density could be lessened, but the improvement is no more than a shift of the MTF toward the lower frequency side, and no high magnification cannot be expected.

On the other hand, those known as the technique for preventing light scattering include the method for coarsening silver halide emulsion grains, the method of adding a coloring material, the method of reducing the layer thickness, and the like.

The first-mentioned method is known for improving the image sharpness by coarsening the grain size of silver halide grains up to the degree where light scattering is minimized. This technique, however, has the disadvantage that the coarsened grains give a visual impression of the deterioration of graininess. The second method is an attempt to improve the image sharpness by the addition of a coloring material, known examples of which include the method for coating an antihalation layer as described in West German OLS Patent No. 2711220, and the method of incorporating a filter dye into a protective layer as described in Japanese Patent O.P.I. Publication No. 161235/1980. These techniques, however, are disadvantageous in respect of decreasing the photographic speed, throwing out of the color balance, increasing fog, etc. of a photographic material. Known as the third method for reducing the layer thickness is the method of largely reducing the coating amount of silver. However, if the coating amount of silver is largely reduced, then the active site is reduced, thereby inviting the deterioration of graininess. The reduction of the layer thickness is also carried out by reducing the gelatin, coupler or coupler solvent in a coating liquid. However, any of these methods is undesirable in respect of inviting the deterioration of the coatability or density of the color formed.

SUMMARY OF THE INVENTION

It is therefore a first object of the present invention to provide a silver halide photographic material improved on the sharpness.

It is a second object of the present invention to provide a silver halide photographic material improved on the sharpness without being degraded in the graininess.

It is a third object of the present invention to provide a silver halide photograhic material having a high photographic speed and improved on the sharpness.

It is a fourth object of the present invention to provide a silver halide photographic material improved on the interimage effect.

It is a fifth object of the present invention to provide a silver halide photographic material improved on the desilverizability.

It is a sixth object of the present invention to provide a silver halide photographic material improved so as to produced little or no fog.

The above-mentioned objects have been accomplished by a silver halide photographic material comprising at least one blue-sensitive silver halide emulsion layer, silver density (d) expressed in terms of the following equation $$d=N/V$$

(wherein, N is the amount of silver contained in the emulsion layer in term of gram and V is the volume of the blue-sensitive emulsion layer in term of $cm^3$) of the emulsion layer being not less than $4.0\times10^{-1}$ g/$cm^3$ and the dry-thickness of the emulsion layer being not more than 4.0 $\mu$m.

DETAILED DESCRIPTION OF THE INVENTION

The present invention, since it is based on an idea quite different from the afore-mentioned conventional techniques and particularly the silver density (d) of the blue-sensitive silver halide emulsion layer is settled in a range as inconceivably wide as $d\geqq4.0\times10^{-1}$ g/$cm^3$, enables to improve the graininess as well as the sharpness, and also largely improve the interimage effect, desilverizability and photographic speed. Particularly, in the blue-sensitive emulsion layer, if a benzoyl-type yellow coupler is used in combination, a significant effect of this invention can be displayed.

In addition, the above-mentioned volume of the blue-sensitive emulsion layer is expressed in terms of the product of the coating area multiplied by the value of the dry thickness of the emulsion layer. If the blue-sensitive emulsion layer of this invention is comprised of two or more layers, the amount of silver and the volume of the layer are calculated as their total values in the respective emulsion layers.

The above silver density in this invention should be not less than $4\times10^{-1}$ g/cm$^3$ to accomplish the objects of this invention. However, in consideration of the graininess and fog, the silver density is preferably not more than 2.0 g/cm$^3$, and more preferably in the range of from $5.0\times10^{-1}$ g/cm$^3$ to 1.2 g/cm$^3$.

The dry thickness of the foregoing blue-sensitive silver halide emulsion layer should as a whole be not more than 4.0 μm. However, if the dry thickness is extremely thin, there arise problems in the coatability, characteristic against pressure, stability of emulsified additives, and color-formability, so that it is preferably not less than 0.8 μm, and more preferably in the range of from 1.0 μm to 3.8 μm.

In the present invention, the silver amount measuring method to be used for determining the above silver density is made in accordance with the atomic absorption anaylysis. And regarding the thickness for determining the volume of the emulsion layer, the cross section of a dry sample is electronmicroscopically enlarged, and on the enlarged image the thicknesses of the respective layers are measured.

Applicable yellow couplers to the blue-sensitive emulsion layer of this invention are acylacetanilide-type couplers. Among these couplers, benzoylacetanilide-type and pivaloylacetanilide-type compounds are useful. Useful examples of such yellow color-forming couplers include those as described in U.S. Pat. Nos. 2,875,057, 3,519,429, 3,265,506, 3,408,194, 3,551,155, 3,582,322, 3,725,072 and 3,891,445, West German Patent No. 1,547,868, West German OLS Patent Nos. 2,219,917, 2,261,361 and 2,414,006, British Patent No. 1,425,020, Japanese Patent Examined Publication Nos. ,19955/1970, 19956/1970, 190303/1971, 19031/1971, 10783/1976, 83410/1976, and Japanese Patent O.P.I. Publication Nos. 26133/1972, 73147/1973, 29432/1973, 6341/1975, 34232/1975, 87650/1975, 123342/1975, 130442/1975, 17438/1976, 21827/1976, 50734/1976, 102636/1976, 82424/1977, 115219/1977, 68180/1979, 73826/1979, 106402/1979, 163721/1979, 46088/1980 and 95237/1981.

The following are examples of the pivaloyl-type coupler usable in the present invention.

(Exemplified Coupler)

(Y-1)

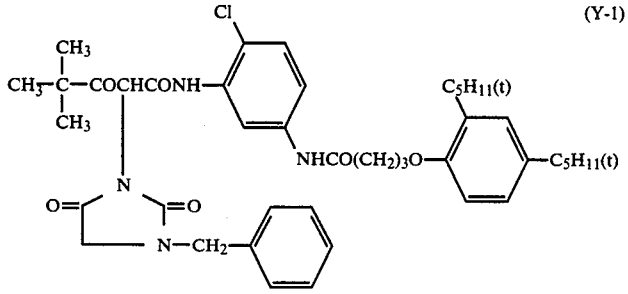

(Y-2)

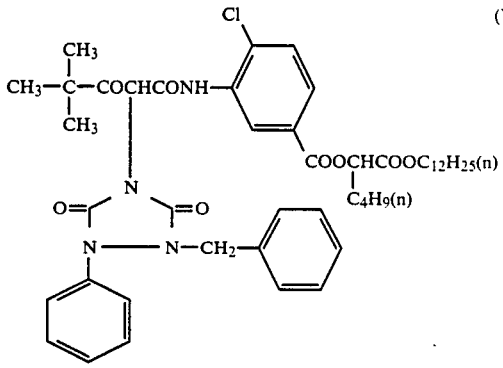

(Y-3)

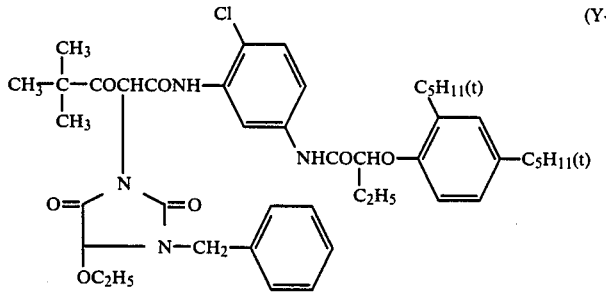

(Y-4)

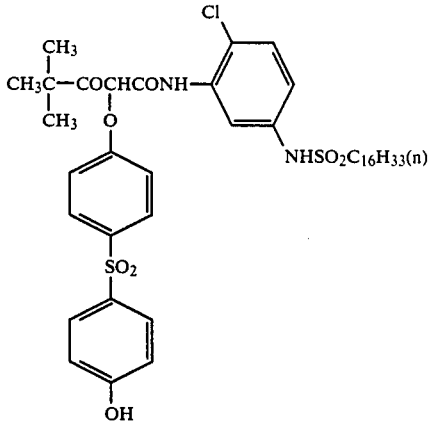

(Y-5)

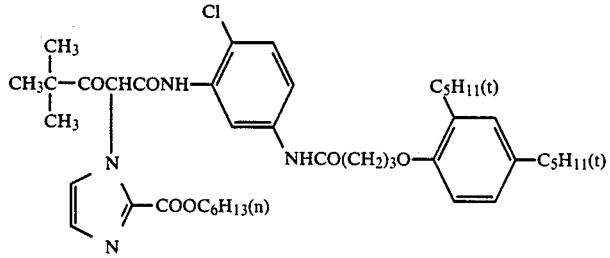

-continued
(Y-6)
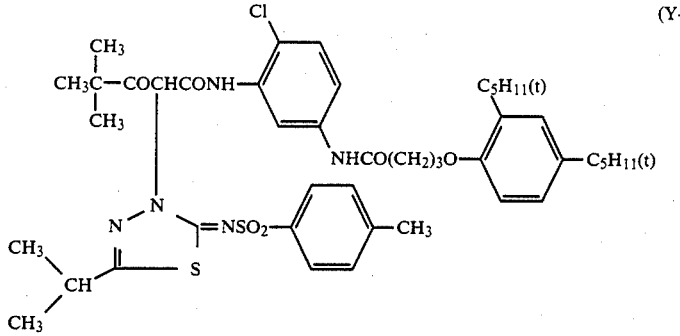
(Y-7)
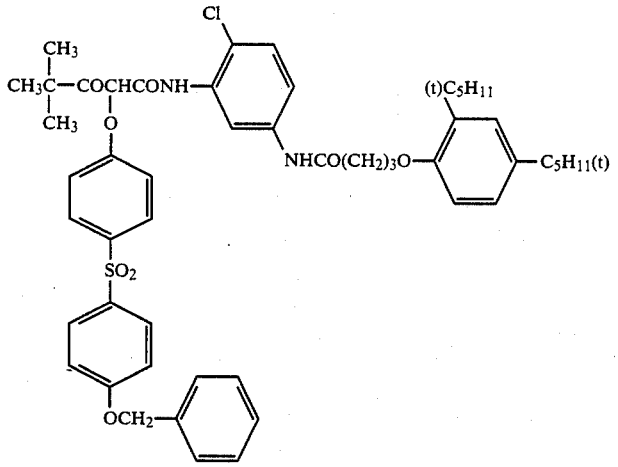
(Y-8)
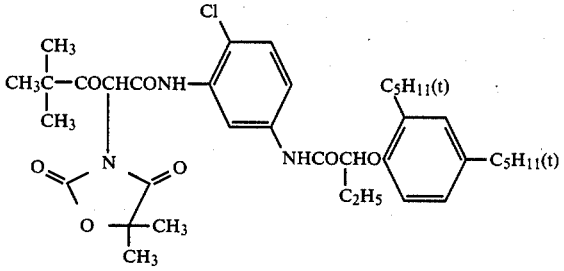
(Y-9)
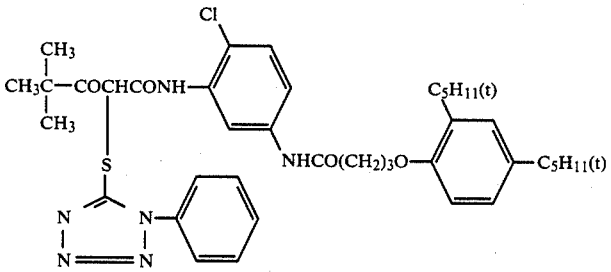
(Y-10)
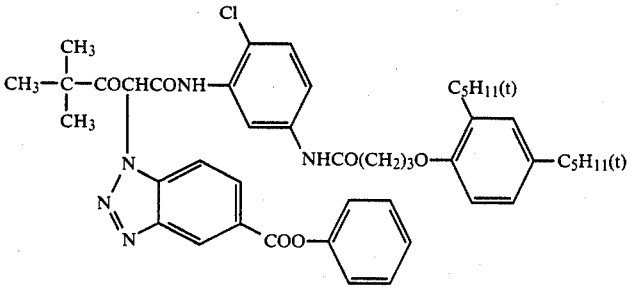

-continued (Y-11)

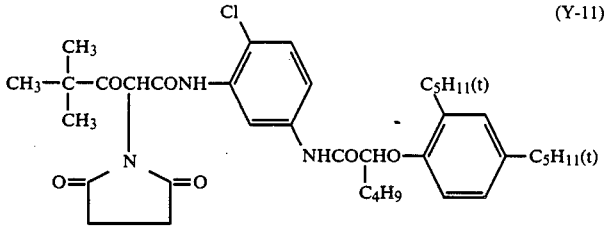

(Y-12)

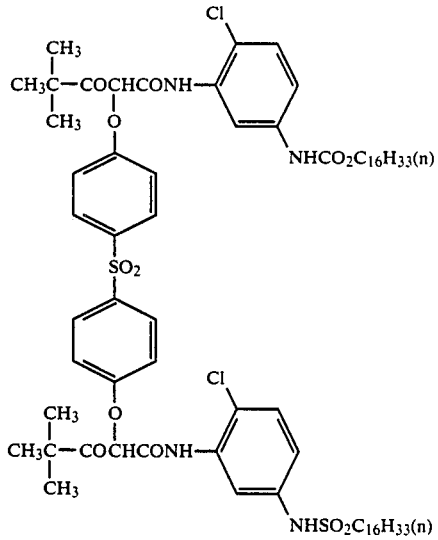

(Y-13)

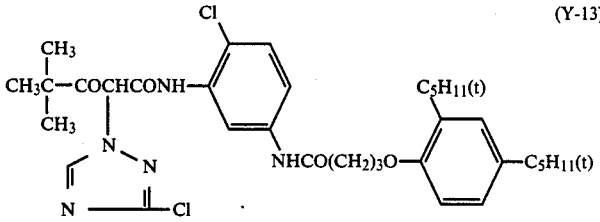

(Y-14)

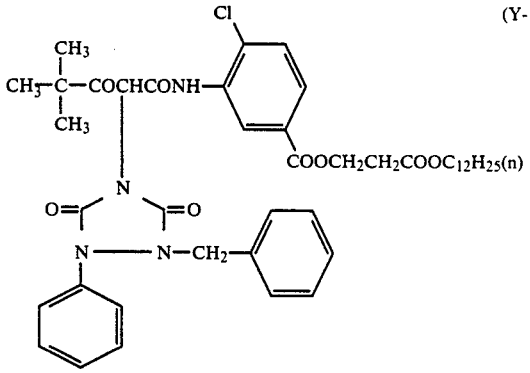

Examples of the benzoyl-type coupler usable of the blue-sensitive emulsion layer of this invention include those yellow dye image-forming couplers having the following general formula [II]:

Formula [I]

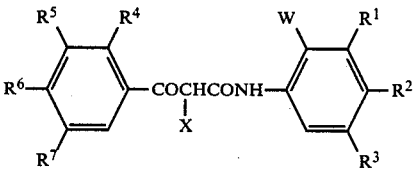

wherein $R^1$, $R^2$ and $R^3$ are allowed to be either the same as or different from one another and each is a hydrogen atom, a halogen atom (e.g., fluorine, chlorine, bromine), an alkyl group (such as methyl, ethyl, allyl, dodecyl), an aryl group (such as phenyl, naphthyl), an alkoxy group (such as methoxy, ethoxy, dodecyloxy), an acylamino group (such as acetamido, α(p-dodecyloxyphenoxy)-butaneamido), a carbamoyl group (such as carbamoyl, N,N-dimethylcarbamoyl, N-δ-(2,4-di-tert-amino-phenoxy), butylcarbamoyl), an alkoxycarbonyl (such as ethoxycarbonyl, dodecyloxycarbonyl, α(dodecyloxycarbonyl)ethoxycarbonyl), a sulfonamido group (such as methanesulfonamido, p-dodecyloxybenzenesulfonamido, N-benzyldodecanesulfonamido), or a sulfamoyl group (such as sulfamoyl, N-methylsulfamoyl, N-δ-(2,4-di-tert-amylphenoxy)butylsulfamoyl, N,N-diethylsulfamoyl);

$R^4$, $R^5$, $R^6$ and $R^7$ may be either the same as or different from one another and each is a hydrogen atom, an alkyl group (such as methyl, ethyl, tert-butyl), an alkoxy group (such as methoxy, ethoxy, propoxy, octoxy), an aryloxy group (such as phenoxy, methylphenoxy), an acylamino group (such as acetamido, α-(2,4-di-tert-amylphenoxy)butaneamide), or a sulfonamido group (such as methanesulfonamido, p-dodecylbenzenesulfonamido, N-benzyldodecanesulfonamido);

W is a halogen atom (such as fluorine, chlorine, bromine), an alkyl group (such as methyl, ethyl, tert-butyl), an alkoxy group (such as methoxy, ethoxy, propoxy, octoxy), an aryloxy group (such as phenoxy, methylphenoxy) or a dialkylamino group (such as dimethylamino, N-butyl-N-octylamino); and X is a hydrogen atom or a group capable of being split off.

Suitable groups as the splittable group are those having the following general formula [II]:

Formula [II]

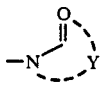

wherein Y is a group of nonmetallic atoms necessary to form a 5- to 6-member cyclic ring (representing a cyclic compound such as, e.g., 2,5-dioxo-imidazoline, 2,5-pyrrolidinedione, 1,3-isoindoledione, 2,3,5-trioxo-imidazoline, 2,5-dioxo-triazolidine, 2,4-oxazolidinedione, 2,4-thiazolidinedione, 2(1H)-pyridone, 2(1H)-pyrimidone, 2(1H)-pyrazone, 5(1H)-imidazolone, 5(1H)-triazolone, 2(1H)-pyrimidone, 2-pyrazolone(5), 2-isothiazolone(5), 2(1H)-quinaoxazolone, 4(3H)-pyrimidone, 2-benzoxazolone, 4-isooxazolone(5), 3-pyrazolone, 2-tetrazolone(5), 3-tetrazolone(5) or the like.

The following are examples of those yellow couplers having Formula [I]:

[Y'-1]

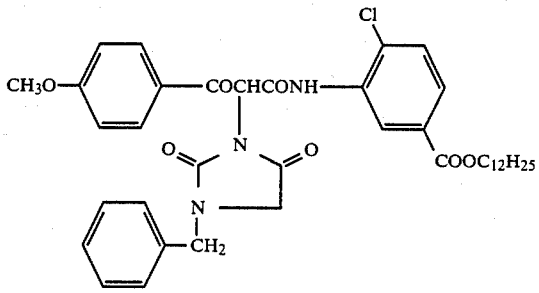

[Y'-2]

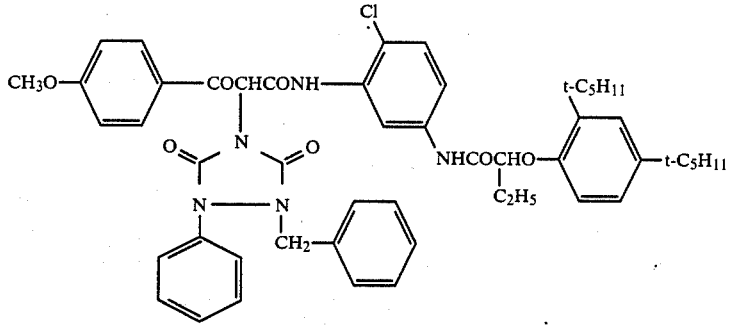

[Y'-3]

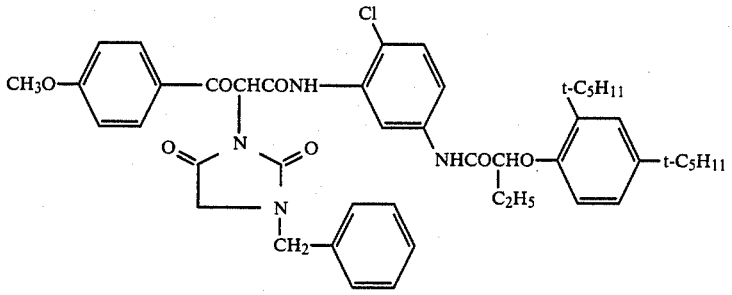

[Y'-4]

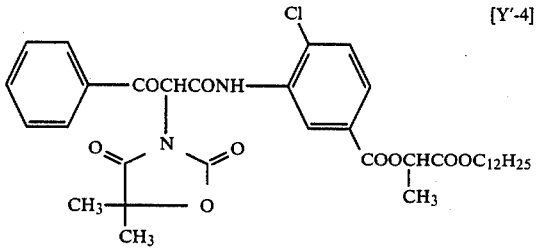

[Y'-5]

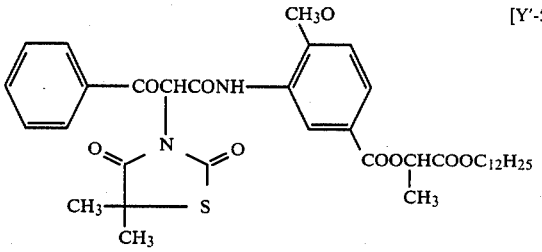

[Y'-6]

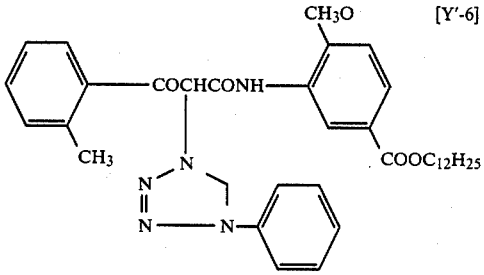

[Y'-7]

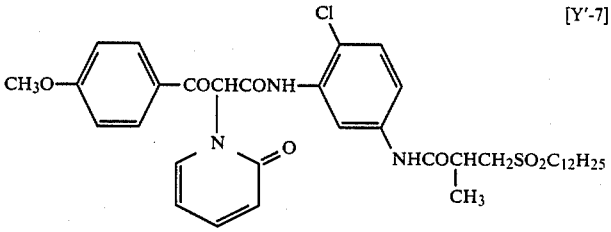

-continued
[Y'-8]
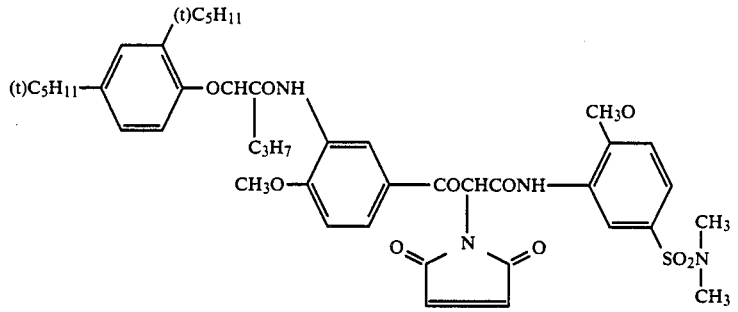
[Y'-9]
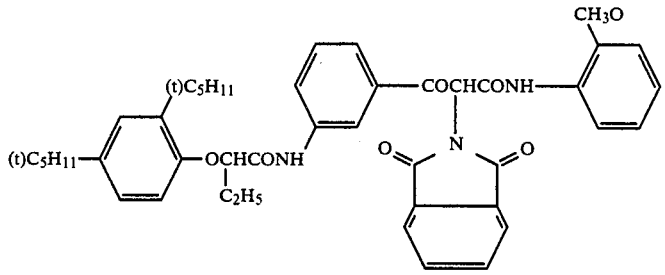
[Y'-10]
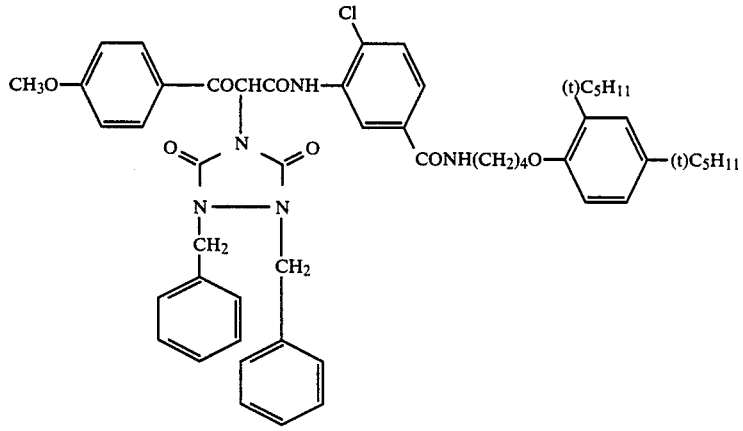
[Y'-11]
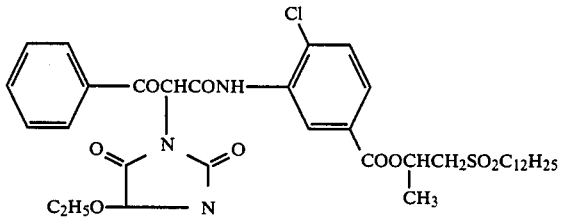
[Y'-12]
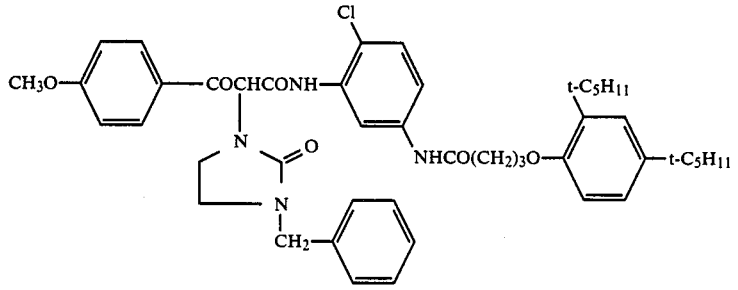

-continued

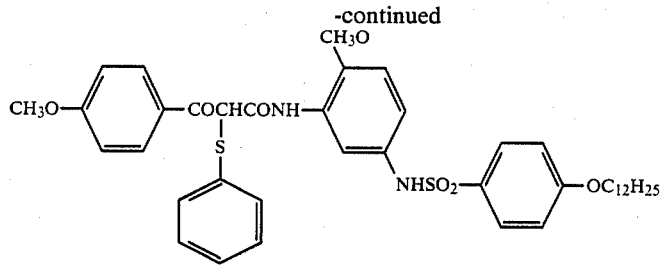

[Y'-13]

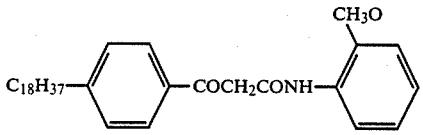

[Y'-14]

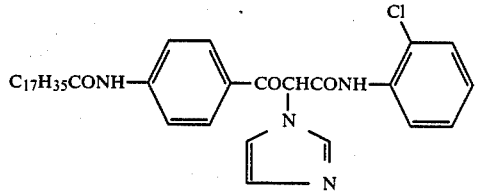

[Y'-15]

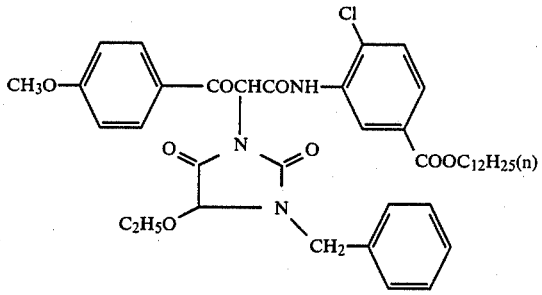

[Y'-16]

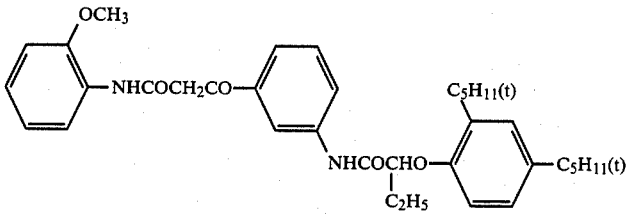

[Y'-17]

These yellow couplers suitably usable in this invention may be used in combination with other yellow couplers.

In the blue-sensitive emulsion layer of this invention, the coupler is used in the quantity range of from 0.1 mole to 30 moles per mole of silver, and preferably from 1.0 mole to 20 moles. The incorporation of the coupler into the silver halide emulsion layer may be carried out by any of known methods such as those described in U.S. Pat. No. 2,322,027. For example, the coupler is dissolved into a solvent such as a alkyl phthalate (dibutyl phthalate, dioctyl phthalate), phosphate (such as diphenyl phosphate, triphenyl phosphate, tricresyl phosphate, dioctylbutyl phosphate), citrate (such as tributylacetyl citrate), benzoate (such as octyl benzoate), alkylamide (such as diethyl layrylamide), fatty acid ester (such as dibutoxyethyl succinate, dioctyl azelate), trimesic acid ester (such as tributyl trimesate), or the like, or into an organic solvent whose boiling point is about 30° to 150° C., e.g., an alkyl acetate such as ethyl acetate, butyl acetate, etc., ethyl propionate, secondary butyl alcohol, methyl-isobutyl ketone, $\beta$-ethoxyethyl acetate, methylcellosolve acetate, or the like, and after that the solution is dispersed into a hydrophilic colloid. The above-mentioned high-boiling organic solvent and low-boiling solvent may be used in a mixture.

It is preferred that the blue-sensitive silver halide emulsion layers relating to the invention are to contain a scavenger for the oxidation products of a developing agent, i.e., a dye-stain inhibitor (hereinafter called an AS agent), so as to inhibit a dye-stain. The particularly preferable scavengers are the high-speed reactive ones having a relative reaction rate (which will be defined later) of from not lower than 1.6 to not higher than 15.0. When a blue-sensitive silver halide emulsion layers relating to the invention contains the above-mentioned scavenger, a further finer graininess may be obtained, because of the synergistic effect of the combination of the scavenger in the layer and the silver in the above-mentioned density range. When using such a high reaction type coupler as described above, the remarkable effects may be enjoyed, such as that the graininess of an emulsion may be improved with making the sharpness excellent and the sensitivity may also be increased.

The above-mentioned relative reaction rate of the AS agents is preferred to be from not lower than 1.6 to not higher than 15.0 so as to achieve the objects of the invention. If the rate is too fast, the sensitivity will be lowered and it is, therefore, the upper limit thereof is to be 15.0. A further poreferred relative reaction rate is from 1.6 to 10.0.

Now, a relative reaction rate of an AS agent shall be defined as follows:

A scavenger, i.e., an AS agent, which is preferably used in a blue-sensitive emulsion layer relating to the invention, include, for example, a high-speed reaction type compound that has a relative reaction speed of not slower than 1.6.

Such a relative reaction rate may be determined, as a relative value, through the measurement of an amount of dyes contained in a dye image obtained in such a manner that a scavenger is mixed up with the above-mentioned coupler and the mixture thereof is further mixed in a silver halide emulsion and a color development is made.

A reaction activity ratio (R) of a scavenger to coupler N, i.e., a relative reaction rate, is to be determined by the following formula:

$$R = \frac{DM}{DM'}$$

wherein, DM represents a color density of coupler N when it does not contain any scavenger; and DM' represents a color density of coupler N when it contains a scavenger in an amount of 1/10 mol of the coupler N.

Coupler N:

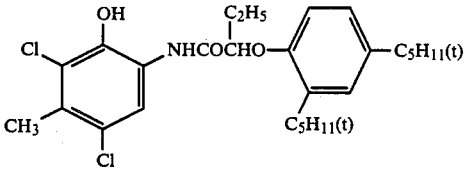

Provided that the above-mentioned R is obtained with respect to various types of scavengers by making use of coupler N, the respective relative values of the reaction rates of the scavengers each with the oxidation products of a color developing agent may be determined.

In the scavengers preferably used in the invention, R is to be not higher than 15, from the viewpoint of preventing a sensitivity from lowering.

An amount of the high-speed reaction type scavengers is not particularly limitative, but is preferably from $1\times10^{-4}$ mol to $5\times10^{-1}$ mol per mol of a coupler used.

The scavengers preferably useful are represented by the following formulas:

[I]

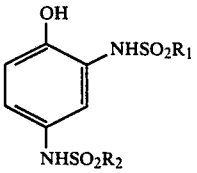

wherein $R_1$: An aryl group, an alkyl group; and $R_2$: An aryl group, an alkyl group; provided that $R_1$ and $R_2$ may be the same with or the different from each other.

[II]

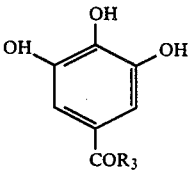

wherein $R_3$: OR', NHR'; (in which R': An aryl group, an alkyl group);

[III]

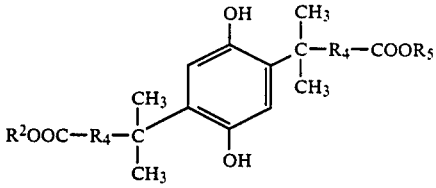

wherein $R_4$: An alkylene group; and $R_5$: An alkyl group, an aryl group.

[IV]

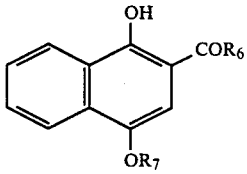

wherein $R_6$:

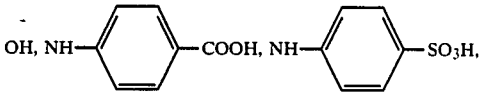

and $NH(CH_2)_2COOH$ $R_7$: An alkyl group, an aryl group.

[V]

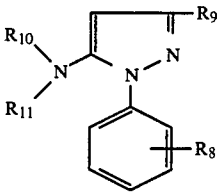

wherein $R_8$: Hydrogen, a halogen, a sulfo group, an acylamino group;

$R_9$: An alkyl group, an alkoxy group; and $R_{10}$ and $R_{11}$: An alkyl group.

The scavengers for the oxidation products of a color developing agent, which relate to the invention, to be used in the emulsion layers were synthesized in the same procedures as those described in Japanese Patent Examined Publication No. 4133/1968; and Japanese Patent O.P.I. Publication Nos. 24141/1983, 45701/1983 and 5427/1984.

The typical high-speed reaction type scavengers will be exemplified below, and it is, however, to be understood that the invention shall not be limited thereto. In the exemplifications, the above-mentioned R values are indicated in the parentheses. The scavengers exemplified below may be used singly or in combination.

[Exemplified Compounds]

(Q-1)
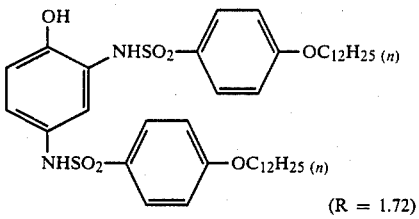
(R = 1.72)
(Q-2)
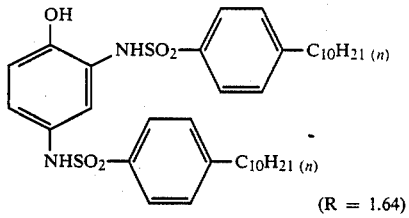
(R = 1.64)
(Q-3)
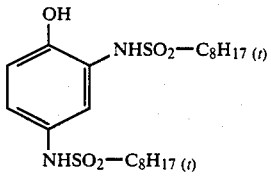
(R = 1.62)
(Q-4)
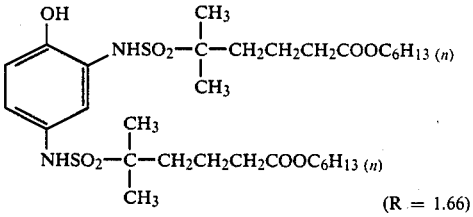
(R = 1.66)
(Q-5)
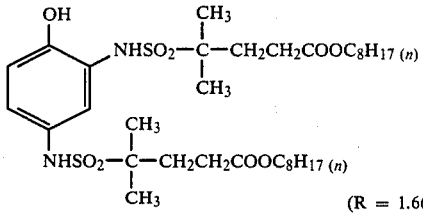
(R = 1.66)
(Q-6)
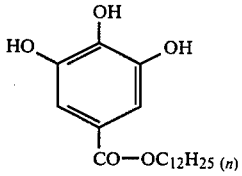
(R = 2.0)
(Q-7)
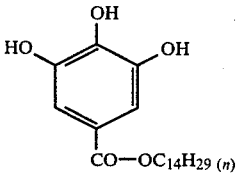
(R = 2.1)
(Q-8)
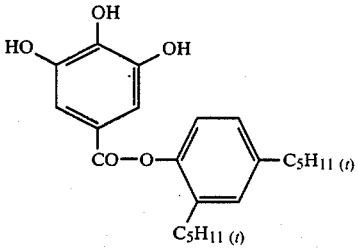
(R = 2.4)
(Q-9)
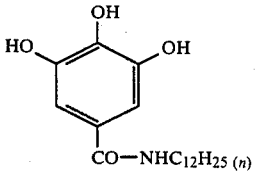
(R = 3.16)
(Q-10)
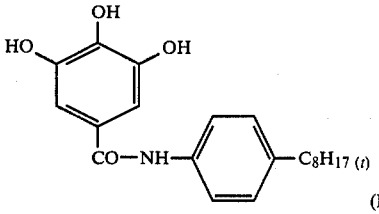
(R = 3.70)
(Q-11)
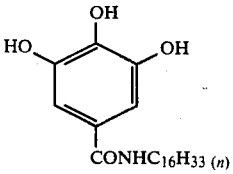
(R = 2.86)
(Q-12)
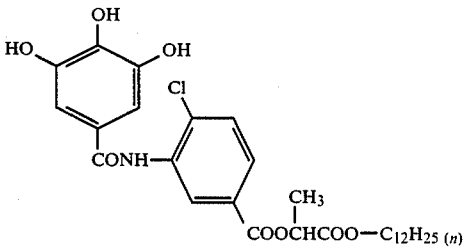
(R = 4.0)
(Q-13)
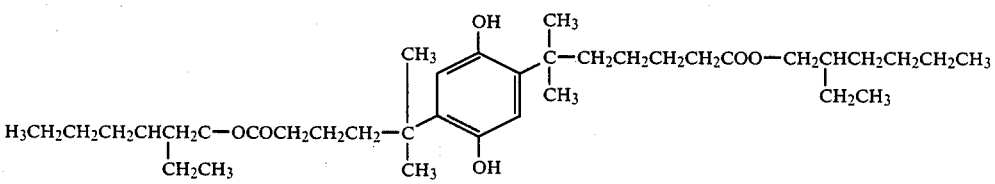
(R = 1.62)

-continued
(Q-14)
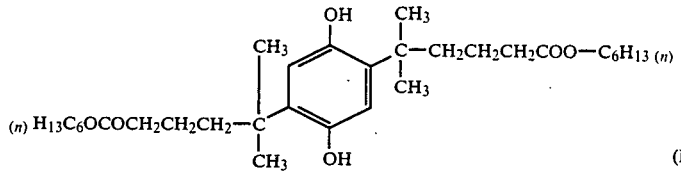
(R = 1.60)
(Q-15)
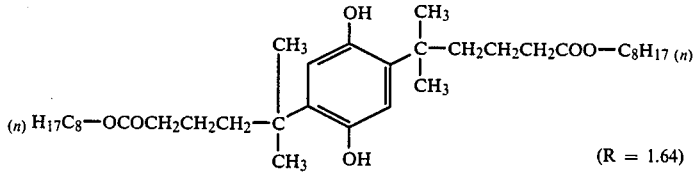
(R = 1.64)
(Q-16)
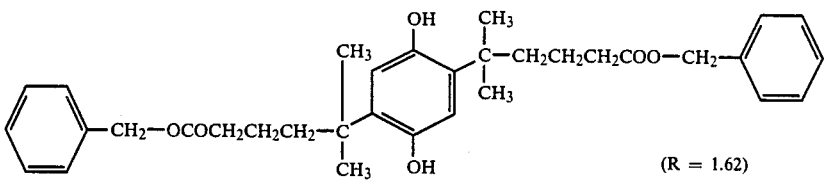
(R = 1.62)
(Q-17)
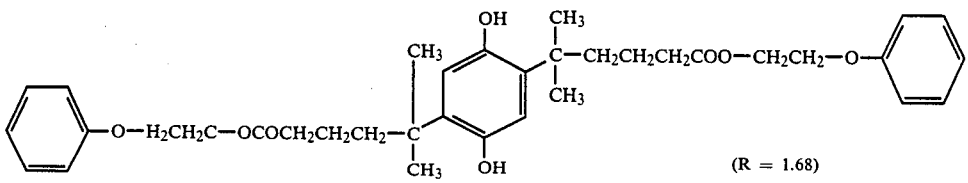
(R = 1.68)
(Q-18)
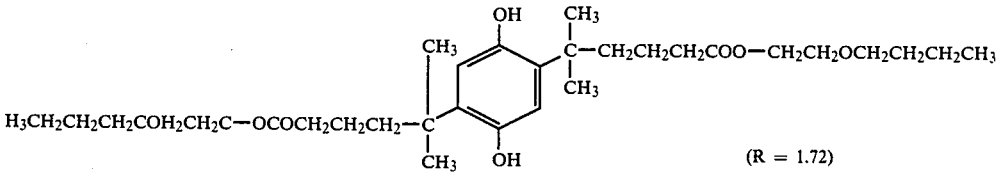
(R = 1.72)
(Q-19)
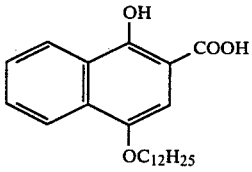
(R = 1.92)
(Q-20)
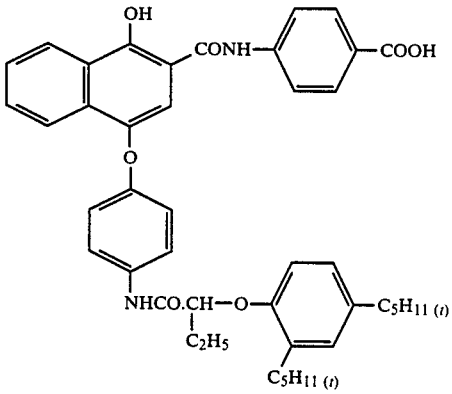
(R = 1.96)

-continued (Q-21)

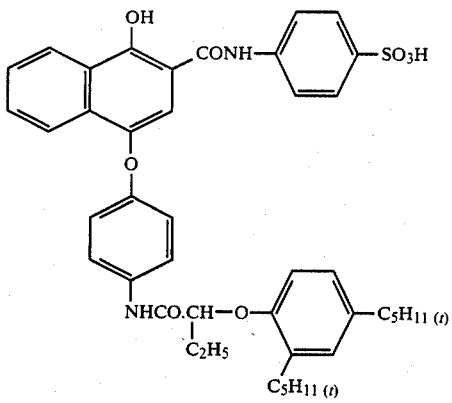

(R = 1.94)

(Q-22)

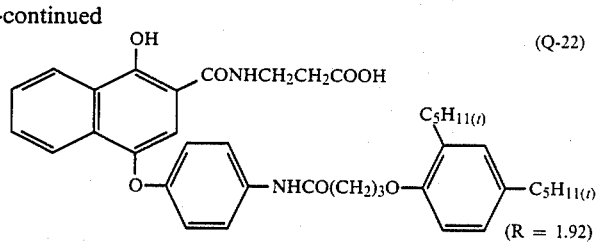

(R = 1.92)

(Q-23)

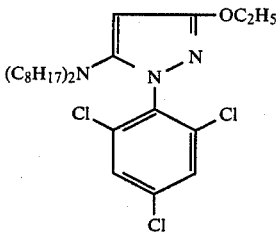

(R = 1.62)

(Q-24)

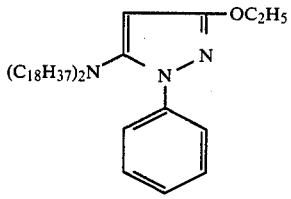

(R = 1.60)

(Q-25)

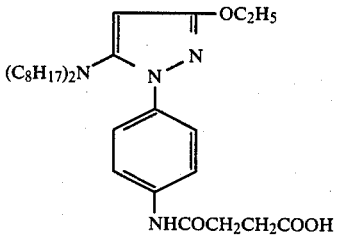

(R = 1.60)

(Q-26)

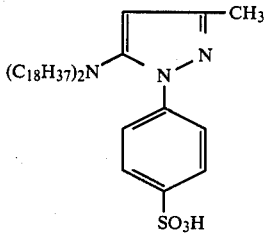

(R = 1.62)

The methods of adding the scavengers of the invention for scavenging the oxidation products of a color developing agent into an emulsion layer will be described below, and any of the methods may be used in the invention.

In the case of containing the scavenger of the invention for the oxidation products of a high-speed reaction type color developing agent into a silver halide emulsion, it is preferred that, if the scavenger for the oxidation products of the color developing agent is alkali-soluble, it may be added in the form of an alkali solution, and if it is oil-soluble, it is dissolved in a high-boiling solvent, and a low-boiling solvent in combination, if required, and is then finely dispersed, so as to be added into a silver halide emulsion. In this instance, it is also allowed to use, if necessary, a UV absorbing agent, a brown-stain inhibitor and the like in combination. It is also allowed to use a mixture of two or more kinds of the scavengers for the oxidation products of a color developing agent. Now, how to add the scavengers for the oxidation products of a color developing agent which is preferably used in the invention will be described more in detail below. One or not less than two kinds of the scavengers for the oxidation products of a color developing agent, together with the other type scavengers for the oxidation products of a color developing agent, couplers, brown-stain inhibitors, UV absorbing agents and the like if required, are dissolved in a high-boiling solvent and/or a low-boiling solvents, such as an organic amide, a carbamate, an ester, a ketone, a urea derivative, an ether, a hydrocarbon and, particularly, di-n-butyl phthalate, tricresyl phosphate, triphenyl phosphate, diisooctyl azelate, di-n-butyl sebacate, tri-n-hexyl phosphate, N,N-di-ethyl-caprylamidobutyl, N,N-diethyllaurylamide, n-pentadecyl phenyl ether, dioctyl phthalate, n-nonyl phenol, 3-pentadecylphenyl ethyl ether, 2,5-di-sec-amylphenyl butyl ether, monophenyl-di-o-chlorophenyl phosphate, fluoroparaffin and the like for the former solvents and methyl acetate, ethyl acetate, propyl acetate, butyl acetate, butyl propionate, cyclohexanol, diethylene glycol monoacetate, nitromethane, carbon tetrachloride, chloroform, cyclohexane tetrahydrofuran, methyl alcohol, acetonitrile, dimethyl formamide, dioxane, methylethyl ketone and the like for the latter solvents; and the resulting solution is mixed with an aqueous solution containing an anionic surfactant, a nonionic surfactant and/or a hydrophilic binder, such as alkylbenzene sulfonic acid and alkylnaphthalene sulfonic acid for the former surfactants, sorbitan sesquioleic acid ester and sorbitan monolauric acid ester for the latter surfactants, and gelating and the like for the binders; further, the resulting mixture is emulsified and dispersed by means of a high-speed rotary mixer, colloid-mill, supersonic homogenizer or the like so as to be added into a silver halide emulsion.

Besides the above, the scavengers for the oxidation products of a color developing agent may also be dispersed in a latex dispersion process. Such latex dispersion processes and the effects thereof are described in, for example, Japanese Patent O.P.I. Publication Nos. 74538/1974, 59943/1976 and 32552/1979, and Research Disclosure, August, 1976, No. 14850, pp. 77~79.

The suitable latices include, for example, the homopolymers, copolymers and terpolymers of such a monomer as styrene, acrylate, n-butyl acrylate, n-butyl methacrylate, 2-acetacetoxyethyl methacrylate, 2-(methacryloyloxy)ethyl trimethyl ammonium methosulfate, 3-(methacryloyloxy)propane-1-sodium sulfonate, N-isopropyl acrylamide, N-[2-(2-methyl-4-oxopentyl)]acrylamide, 2-acrylamido-2-methylpropane sulfonic acid or the like.

It is also allowed that the scavengers for the oxidation products of a color developing agent may be dissolved in the above-mentioned low-boiling solvents and then added into a silver halide emulsion.

In the invention, the green-sensitive emulsion layers, which are to be used in combination with the above-mentioned blue-sensitive emulsion layers, are preferable provided that the silver density thereof is not less than $5.0\times10^{-1}$ g/cm$^3$ and the dried layer thickness thereof is not more than 4.5 μm, from the viewpoint that the sharpness of a photosensitive material may be improved. The silver density of the green-sensitive emulsion layers is, more preferably, not more than 2.0 g/cm$^3$ and, particularly, from $7.0\times10^{-1}$ to 2.0 g/cm$^3$, and the dried layer thickness thereof is, more preferably, not less than 0.8 μm and, particularly, from 1.0 to 4.0 μm.

It is also preferable to contain the above-mentioned high-speed reaction type scavengers into the above-mentioned green-sensitive emulsion layers, so that the sharpness and graininess of a photosensitive material may be improved and a color-stain may also be reduced.

The preferable processes of using the high-speed reaction type scavengers in the photosensitive materials of the invention also include, for example, a process in which a non-photosensitive layer is so arranged as to be adjacent to the above-mentioned blue- and/or green-sensitive emulsion layers and the above-mentioned high-speed reaction type scavengers are contained in the non-photosensitive layers. The high-speed reaction type scavengers may be contained in at least one of the blue-, green- and non-photosensitive layers. However, it is also allowed that the scavengers may be contained in any two or all the layers.

The silver halide to be used in the photographic emulsion layer of the photographic material of this invention may be any of silver bromide, silver iodobromide, silver iodochlorobromide, silver chlorobromide and silver chloride.

No particular restrictions are placed on the average grain size (the average of grain diameters where each grain is spherical or nearly spherical, or where each grain is cubic, the average grain size is expressed in terms of the average of the edge lengths thereof regarded as grain sizes, measured according to the projected areas) of the silver halide grains in the photographic emulsion, but the average grain size is desirable to be not more than 3 μm. The grain size distribution may be either narrower or wider.

The silver halide grain in the photographic emulsion is allowed to be in the form of a regular crystal such as a cubic or octahedral form, or of an irregular crystal such as a spherical or plate form, or else of a complex of these crystal forms. Further the silver halide may be of a mixture of these various crystal forms-having grains.

The silver halide grain is allowed to be of either a heterogeneous structure with its inside different from its surface stratum or a homogeneous structure uniformly stratified, and also of either the type of forming a latent image mainly on its surface or the type of forming a latent image mainly inside it.

The photographic emulsion of this invention may be prepared by any of known methods including the acidic method, neutral method, ammoniacal method, and the like. Regarding the reaction form of a water soluble silver salt with a water-soluble halide, any of the single-jet mixing method, double-jet mixing method, and combination of these methods may be used.

Alternatively, the method of forming grains in the presence of excessive silver ions (inversely mixing method) may also be used. As one form of the simultaneous mixing method, a method in which the pAg of a silver halide-forming liquid phase is maintained constant; the so-called double jet method, may also be used. According to this method, a silver halide emulsion having a regular crystalline form and nearly uniform grain size can be obtained.

Separately formed two or more silver halide emulsions may also be mixed to be used.

In the course of forming or ripening the silver halide grains a cadmium salt, zinc salt, lead salt, thalium salt, iridium salt or iridium complex salt, rhodium salt or rhodium complex salt, iron salt or iron complex salt may be made present in the silver halide emulsion.

As described above, a variety of silver halide emulsions may be applied to the blue-sensitive emulsion layers relating to the invention. The more preferable silver halide emulsions include, for example, a core/-shell type silver halide emulsion which is comprised of a core substantially containing silver bromide and/or silver iodobromide and a plurality of shells substantially containing silver bromide and/or silver iodobromide, wherein the outermost shell thereof contains silver iodide in a proportion of not more than 10 mol% and one of the shells arranged to the inner side of the outermost shell contains silver iodide not less than 6 mol% more than that of the outermost shell, (the latter is hereinafter referred to as a highly iodide-containing shell). The particularly preferable ones include, for example, those arranged with an intermediate shell between the above-mentioned outermost shell and a highly iodide-containing shell so that the intermediate shell may be able to contain iodide not less than 3 mol% more than that of the outermost shell and the highly iodide-containing shell may be able to contain iodide not less than 3 mol% more than that of the intermediate shell.

In the silver halide composition of the silver halide grains relating to the invention, the expression, 'substantially comprising . . . ', means that it is allowed to contain such a silver halide as silver chloride other than silver bromide or silver iodide provided that the effects of the invention may not be hindered from displaying and, to be more concrete, it is desired that the content thereof is to be not more than 1 mol% in the case of silver chloride.

The above-mentioned core/shell type emulsions are characterized, if used, in the following points:

1. An excellent graininess and wide exposure range may be enjoyed by making use of an emulsion containing core/shell type silver halide grains each having a high iodide-containing shell thereinside, as compared with non-core/shell type emulsions.

2. The iodide content of the high iodide-containing shell is preferably from 6 to 40 mol% and is to be not less than 6 mol% more than that of the outermost shell. If the above-mentioned iodide content is less than 6 mol% (or, if it is merely less than 6 mol% more than that of the outermost shell), the sensitivity of the emulsions may be lowered. On the other hand, if the content thereof is excessive over 40 mol%, the emulsions may be polydispersed. It is, therefore, desired that the content thereof is not to be excessive over 40 mol%, from the viewpoints of the sensitivity of emulsions and sharpness of images.

3. If a total iodide content of all the silver halide grains is too large, the developability of the emulsions may tend to be worsened and the sensitivity thereof may tend to be lowered; and if it is too small, the gradation may tend to be hardened and the exposure range may tend to be narrowed and, further, the graininess may tend to be deteriorated. It is, therefore, preferred to choose the specific range of the content.

4. Monodisperse emulsions are superior to polydisperse emulsions in sensitivity, sharpness and the relation between fog and sensitivity. Namely, in the polydisperse emulsions, an ideal core/shell structure may hardly be produced, because of an irregular reaction of forming shells; fine grains are present, so that the sharpness may be deteriorated; the sensitivity tends to be lowered and the relation between fog and sensitivity tends to be worsened, because the optima of a chemical sensitization to be made after forming grains are varied according to the individual grains. It is, therefore, preferred to use the monodisperse emulsions.

For a further improvement of the above-mentioned excellent advantages, provided that;

Ih: An iodide content of a high iodide-containing shell (at mol%)

Im: An iodide content of an intermediate shell (at mol%)

Il: An iodide content of the outermost shell (at mol%); it is preferred to be $\Delta I = Ih - Il > 8$ mol%, $\Delta Ih = Ih - Im > 4$ mol% and $\Delta Il = Im - Il > 4$ mol%; and more preferably $\Delta Il > 10$ mol%, $\Delta Ih > 4$ mol% and $\Delta Il > 4$ mol%; wherein it is desired to be $Il = 0$ to 5 mol%, more desirably $Il = 0$ to 2 mol% and further desirably $Il = 0$ to 2 mol%; and it is preferred to be $Ih = 6$ to 40 mol% and more preferably $Ih = 10$ to 40 mol%. [Refer to the above-mentioned Item (2)]

The volume of the outermost shell is preferably from 4 to 70% of all the grains and more preferably from 10 to 50% thereof. The volume of the high iodide-containing shell is preferably from 10 to 80% of all the grains, more preferably from 20 to 50% thereof and further preferably from 20 to 45% thereof. The volume of the intermediate shell is preferably from 5 to 60% and more preferably from 20 to 55%. The high iodide-containing shell may be at least a part of an inner shell and it is preferred to make a separate inner shell present inward the high iodide-containing shell.

The iodide content of the inner shell is preferably from 0 to 40 mol%, more preferably from 0 to 10 mol% and further preferably from 0 to 6 mol%. The grain size of the inner shell is preferably from 0.05 to 0.8 μm and more preferably from 0.05 to 0.4 μm.

Further, in the aforementioned characteristic point (3), the iodide content of all the grains is desirably from 1 to 30 mol%, more desirably from 1 to 25 mol% and further desirably from 2 to 20 mol%. In the aforementioned characteristic point (4), a grain-size distribution is to preferably be not higher than 20% in a monodisperse emulsion, though either of the polydisperse emulsions and monodisperse emulsions will do, and more preferably not higher than 15%. The above-mentioned variation coefficient shall be specified by the following formula that serves as the scale indicating a monodispersibility:

$$\text{Variation coefficient (\%)} = \frac{\text{Standard deviation}}{\text{Average grain size} \times 100}$$

The grain size of a silver halide grain (which is defined as a length of one side of a cube having the same volume as that of the silver halide grain) is to preferably be from 0.1 to 3.0 μm. The configuration thereof may be any one of octahedral, cubic, spherical and plate-like configurations, for example, and the octahedron is preferable.

The layer arrangement of the silver halide grains relating to the invention will further be described below:

The inner shell and high iodide-containing shell may be the same, or a separate inner shell may be arranged to the inside of the high iodide-containing shell, as described above. It is also allowed that the inner shell and the high iodide-containing shell, the high iodide-containing shell and the intermediate shell or the intermediate shell and the outermost shell are adjacent to each other, respectively, and that at least one shell having any arbitrary composition may be provided between the above-mentioned shells (hereinafter referred to as an arbitrary shell).

The above-mentioned arbitrary shells may be any one of a unitary shell having a uniform composition, a group of a plurality of shells having a uniform composition capable of changing stepwise, such a series of continuous shells capable of continuously changing their compositions in the arbitrary shells, or the comibination thereof. Besides, the high iodide-containing shell and intermediate shell may also be present plurally or in only a pair.

Next, the examples of the above-mentioned layer arrangement of the silver halide grains relating to the invention will now be described below, wherein an iodide content is represented by I.

1. An inner shell = A 3-layer arrangement of a high iodide-containing shell:

| | Iodide content | Shell diameter |
|---|---|---|
| Core (The 3rd) (An inner shell = An high iodide-containing shell) | | |
| $I_3 - I_2 > 3$ mol % | $I_3 = 15$ mol % | 1.2 μm |
| 2nd shell (An intermediate shell) | | |
| $I_2 - I_1 > 3$ mol % | $I_2 = 5$ mol % | 1.4 μm |
| 1st shell (The outermost shell) | | |
| $I_1 = 0$ to 10 mol % | $I_1 = 0.5$ mol % | 1.6 μm |

2. A 6-layer arrangement containing the 4th and 5th shells each having any arbitrary composition provided between an inner shell and a high iodide-containing shell.

| | Iodide content | Shell diameter |
|---|---|---|
| Core (The 6th) (An inner shell) | | |
| An arbitrary core | $I_6$ = 4.0 mol % | 0.1 μm |
| 5th shell (An arbitrary shell) | | |
| An arbitrary shell | $I_5$ = 2.0 mol % | 0.27 μm |
| 4th shell (An arbitrary shell) | | |
| An arbitrary shell | $I_4$ = 2.6 mol % | 0.8 μm |
| 3rd shell (A high iodide-containing shell) | | |
| $I_3$-$I_2$ > 3 mol % | $I_3$ = 15.0 mol % | 1.12 μm |
| 2nd shell (An intermediate shell) | | |
| $I_2$-$I_1$ > 3 mol % | $I_2$ = 5.0 mol % | 1.44 μm |
| 1st shell (The outermost shell) | | |
| $I_1$ = 0 to 10 mol % | $I_1$ = 0.5 mol % | 1.6 μm |

3. A 7-layer arrangement having the arbitrary 5th and 6th shells provided between an inner core and high iodide-containing shell and also having two intermediate shells provided between the outermost shell and the high iodide-containing shell.

| | Iodide content | Shell diameter |
|---|---|---|
| 7th shell (An inner core) | | |
| | $I_7$ = 4.0 mol % | 0.10 μm |
| 6th shell (An arbitrary shell) | | |
| An arbitrary shell | $I_6$ = 2.0 mol % | 0.27 μm |
| 5th shell (An arbitrary shell) | | |
| An arbitrary shell | $I_5$ = 8.0 mol % | 0.8 μm |
| 4th shell (A high iodide-containing shell) | | |
| $I_4$-$I_3$ > 3 mol % | $I_4$ = 15.0 mol % | 1.12 μm |
| 3rd shell (An intermediate shell) | | |
| $I_3$-$I_1$ > 3 mol %<br>$I_4$-$I_3$ > 3 mol % | $I_3$ = 8.0 mol % | 1.24 μm |
| 2nd shell (An intermediate shell) | | |
| $I_2$-$I_1$ > 3 mol %<br>$I_4$-$I_2$ > 3 mol % | $I_2$ > 4.0 mol % | 1.44 μm |
| 1st shell (The outermost shell) | | |
| $I_1$ = 0 to 10 mol % | $I_1$ = 0.5 mol % | 1.6 μm |

4. An 8-layer arrangement having the arbitrary 6th and 7th shells between an inner core and a high iodide-containing shell, and arbitrary shell (i.e., the 4th shell) between the high iodide-containing shell (i.e., the 5th shell) and an intermediate shell (i.e., the 3rd shell), and an arbitrary shell (i.e., the 2nd shell) between the intermediate shell (i.e., the 3rd shell) and the outermost shell, respectively.

| | Iodide content | Shell diameter |
|---|---|---|
| 8th shell (An inner core) | | |
| An arbitrary shell | $I_8$ = 4.0 mol % | 0.10 μm |
| 7th shell (An arbitrary shell) | | |
| An arbitrary shell | $I_7$ = 2.0 mol % | 0.27 μm |
| 6th shell (An arbitrary shell) | | |
| An arbitrary shell | $I_6$ = 4.0 mol % | 0.8 μm |
| 5th shell (A high iodide-containing shell) | | |
| $I_5$-$I_3$ > 3 mol % | $I_5$ = 15.0 mol % | 1.12 μm |
| 4th shell (An arbitrary shell) | | |
| An arbitrary shell | $I_4$ = 9.0 mol % | 1.24 μm |
| 3rd shell (An intermediate shell) | | |
| $I_3$-$I_1$ > 3 mol % | $I_3$ = 5.0 mol % | 1.44 μm |
| 2nd shell (An arbitrary shell) | | |
| An arbitrary shell | $I_2$ = 4.5 mol % | 1.50 μm |
| 1st shell (The outermost shell) | | |
| $I_1$ = 0 to 10 mol % | $I_1$ = 2.0 mol % | 1.6 μm |

5. An arrangement in which a plurality of high iodide-containing shells.

| | Iodide content | Shell diameter |
|---|---|---|
| 6th shell (An inner core) | | |
| An arbitrary shell | $I_6$ = 4 mol % | 0.10 μm |
| 5th shell (A high iodide-containing shell) | | |
| $I_5$-$I_2$ > 3 mol %<br>$I_5$-$I_1$ > 6 mol % | $I_5$ = 15 mol % | 0.27 μm |
| 4th shell (An arbitrary shell) | | |
| An arbitrary shell | $I_4$ = 5 mol % | 0.80 μm |
| 3rd shell (A high iodide-containing shell) | | |
| $I_3$-$I_2$ > 3 mol %<br>$I_3$-$I_1$ > 6 mol % | $I_3$ = 15 mol % | 1.12 μm |
| 2nd shell (An intermediate shell) | | |
| $I_2$-$I_1$ > 3 mol % | $I_2$ = 5 mol % | 1.44 μm |
| 1st shell (The outermost shell) | | |
| $I_1$ = 0 to 10 mol % | $I_1$ = 0.3 mol % | 1.60 μm |

The inner cores of the silver halide grains relating to the invention can be prepared in such a process as described in, for example, P. Glafkides, 'Chimie et Physique Photographique', published by Paul Montel, 1967; G. F. Duffin, 'Photographic Emulsion Chemistry', published by The Focal Press, 1966; V. L. Zelikman et al, 'Making and Coating Photographic Emulsion', published by The Focal Press, 1964; and the like. Namely, any processes such as an acid process, a neutral process and an ammoniacal process, may be applied, and any reaction processes of a soluble silver salt with a soluble halide salt, such as a single-jet precipitation process, a double-jet precipitation process and the combination thereof, may be used.

There may also be used the so-called 'reverse precipitation process' that is a process for forming grains in an excess of siliver ions.

As for one of the double-jet precipitation processes, there may further be used the so-called 'controlled double-jet precipitation process', that is a process for keeping constant a pAg value in a liquid phase where a silver halide may be produced. In this process, there may be prepared a silver halide emulsion which is regular in crystal form and approximately uniform in grain size.

It is also allowed to use the mixture of two or more kinds of silver halide emulsions which were separately prepared. It is, however, preferred to use the double-jet or controlled double-jet precipitation process.

The pAg values preferably applicable to the preparation of an inner core may be varied from 2 to 11, depending upon the reaction temperatures thereof and the kinds of silver halide solvents to be used therein. It is also preferred to use the silver halide solvents including the well-known ones such as ammonia, thioether and the like, because they may be able to shorten the grain-forming time.

As for the configurations of the inner cores capable of being used therein, there may also include those in plate-shaped, globular-shaped and, besides, a twinned, octahedral, cubic or tetradecahedral crystal system and the combination systems thereof.

For the purpose of uniforming grain sizes, it is preferred that such grains are to be grown up substantially faster, provided, however, that the critical saturation shall be maintained, by applying a method of varying the rates of adding silver nitrate and a halogenated alkali aqueous solution according to the grain growth rate, such as the methods described in, for example, British Pat. No. 1,535,016 and Japanese Patent Examined Publication Nos. 36890/1973 and 16364/1977; or by applying a method of varying the concentrations of aqueous solutions, such as the methods described in, for example, U.S. Pat. No. 4,242,445 and Japanese Patent O.P.I. Publication No. 158124/1980. Such a method as described above may also preferably be applied to the cases for introducing arbitrary shells, high iodide-containing shells, intermediate shells or the outermost shell into a grain, because no nucleus may be regenerated and each silver halide grain may uniformly be coated with the shells.

Between every high iodide-containing shell and every inner core of the core/shell type silver halide grains relating to the invention, a single or a plurality of arbitrary shells may be arranged if required. The above-mentioned high iodide-containing shell may be arranged in such a method as an ordinary halogen-substitution method or a silver halide coating method which is to be applied, if necessary, after a formed inner core or an inner core provided thereto with an arbitrary shell is desalted.

Such halogen-substitution method may be carried out in such a manner, for example, that an aqueous solution mainly comprising an iodide compound (e.g., preferably, potassium iodide), and more preferably, that of not more than 10% in concentration is added after an inner core is completed. This method may be carried out as detailedly described in, for example, U.S. Pat. Nos. 2,592,250 and 4,075,020; Japanese Patent O.P.I. Publication No. 127549/1980; and the like. For decreasing the difference of the iodide distributions in the grains of high iodide-containing shells, it is desired that the aqueous iodide solution is so concentrated as to be not higher than $10^{-2}$ mol% and then added in portions by taking not shorter than 10 minutes.

The methods for further coating a silver halide over to an inner core include, for example, a double-jet precipitation and controlled double-jet precipitation methods in which an aqueous halide solution and an aqueous silver nitrate solution are simultaneously added, and more detailedly, the methods described in, for example, Japanese Patent O.P.I. Publication Nos. 22408/1978 and 14829/1983; Japanese Patent Examined Publication No. 13162/1978; Journal of Photographic Science, 24,198, 1976; and the like.

The pAg values which are to preferably be applied to form the high iodide-containing shells are the similar ones applied to the above-mentioned inner cores, provided, however, that such as pAg value may be varied according to the reaction temperatures and the kinds and quantity of silver halide solvents. If using ammonia to serve as the solvent, the pAg value is preferably from 7 to 11.

Among the methods of forming such high iodide-containing shells, the double-jet precipitation and controlled double-jet precipitation methods are more preferred to use.

The intermediate shells of the silver halide grains relating to the invention can be arranged in such a manner that a silver halide having a different halide composition from those of the high iodide-containing shells is coated on, by a double-jet or controlled double-jet precipitation method, to the outside of grains each of which contains the inner core and has a high iodide-containing shell on the surface thereof, or contains the inner core and having a high iodide-containing shell having, if required, a single or a plurality of arbitrary shells thereon.

The methods of arranging the high iodide-containing shells may similarly be applied for the above-mentioned purpose.

The outermost shell of the silver halide grains relating to the invention can be arranged in such a manner that a silver halide having a different composition from those of the high iodide-containing shells and intermediate shells is coated on, by a double-jet precipitation or controlled double-jet precipitation method, to the outside of the grains each of which contains the high iodide-containing shells and the inner core and has either an intermediate shell on the surface thereof or an intermediate shell having thereon, if required, a single or a plurality of arbitrary shells.

The above-mentioned method of arranging the high iodide-containing shell may similarly be applied for this purpose.

If required, a single or a pluralty of the arbitrary shells may be arranged between the inner core and the high iodide-containing shell, the high iodide-containing shell and the intermediate shell, or the intermediate shell and the outermost shell, respectively, or, any one of such arbitrary shells may not also be arranged at all. The above-mentioned method of arranging the high iodide-containing shells may also similarly be applied for arranging the arbitrary shells. When a shell is so arranged as to be adjacent to the inner core, high iodide-containing shells, intermediate shells, outermost shell or arbitrary shells arranged to various positions, a desalting treatment may, if required, be carried out in the course of the above-mentioned shell arrangements, in an ordinary method, or the shell formation may be carried out continuously without interposing any desalting treatment.

The iodide contents of each coated shell of the silver halide grains relating to the invention may also be obtained in the method described in, for example, J. I. Goldstein and D. B. Williams, 'X-Ray Analyses in TEM/ATEM', Scanning Electron Microscopy, 1977, Vol. 1, IIT Research Institute, p. 651, March, 1977.

In the silver halide grains relating to the invention completed as the final product after the outermost shell is formed, any excessive halide compounds procuded in the course of the preparation, or nitrates, any ammonia salts or the like and compounds each by-produced or disused may be removed from the dispersion media of the grains. The appropriate methods to removing them include, for example, a noodle-washing method; a dialyzing method; a precipitation method utilizing an inorganic salt, an anionic surfactant, an anionic polymer such as polystyrene sulfonic acid, or a gelatin derivative such as acylated gelatin, a carbamoylated gelatin and the like; a flocculation precipitation method; or the like; which have popularly been used for ordinary type emulsions.

The core/shell type silver halide grains relating to the invention may be optically sensitized in a desired wavelength region. There is no particular limitation to the optical sensitization methods. For example, the optical sensitizers including cyanine and merocyanaine dyes such as zeromethine, monomethine, dimethine and trimethine dyes may be used independently or in combination for optical sensitization. Such a combination of the sensitizing dyes as described above is often used in particular with the purpose of supersensitizing silver halide grains. It is also allowed that an emulsion may contain not only sensitizing dyes but also a dye not having any optical sensitizing capability in it self or a substance substantially incapable of absorbing any visible rays of light but capable of displaying a supersensitization effect. These techniques are described in, for example, U.S. Pat. Nos. 2,688,545, 2,912,329, 3,397,060, 3,615,635 and 3,628,964; British Pat. Nos. 1,195,302, 1,242,588 and 1,293,862; West German (OLS) Pat. Nos. 2,030,326 and 2,121,780; Japanese Patent Examined Publication Nos. 4936/1968 and 14030/1969; Research Disclosure, Vol. 176, No. 17643, issued in December, 1978, p. 23, Article IV-J; and the like. The techniques may be suitably selected in accordance with a wavelength region to be sensitized, the sensitivity of an emulsion, the use of purpose of a photosensitive material and the like.

The crystals of the core/shell type silver halide relating to the invention may be chemically sensitized in various processes usually applied to the ordinary type emulsions.

For the above-mentioned chemical sensitization, there may be able to use the methods described in, for example, H. Frieser, 'Die Grundlagen der Photographische Prozesse mit Silberhalogeniden', published by Akademischen Verlagsgesellschaft, 1968, pp. 675~734. Namely, there may be able to use a sulfur sensitization process using an active gelating and a sulfur-containing compound capable of reacting with silver ions; a reduction-sensitization process using a reducible substance; a nobel-metal sensitization process using gold or other noble-metal compounds; and the like; independently or in combination.

The sulfur sensitizers include, for example, a thiosulfate, a thiourea, a thiazole, a rhodanine and other compounds, and the typical sulfur sensitizers are exemplified in, for example, U.S. Pat. Nos. 1,574,944, 2,410,689, 2,278,947, 2,728,668, 3,656,955, 4,032,928 and 4,067,740.

The reduction sensitizers include, for example, a stannous salt, an amine, a hydrazine derivative, formamidine-sulfinic acid, a silane compound and the like, and the typical reduction sensitizers are exemplified in, for example, U.S. Pat. Nos. 2,487,850, 2,419,974, 2,518,698, 2,983,609, 2,983,610, 2,694,637, 3,930,867 and 4,054,408.

The noble-metal sensitizers include, for example, a gold complex salt and a metal complex salt belonging to the VIII group of the periodic table such as platinum, iridium, palladium and the like, and the typical noble-metal sensitizers are exemplified in, for example, U.S. Pat. Nos. 2,399,083 and 2,448,060; British Pat. No. 618,061; and the like.

The silver salt grains relating to the invention may be applied with the above-mentioned chemical sensitization processes in combination.

The photosensitive layers each containing the above-mentioned grains may be present on the both sides of a support.

Various types of dopants may also be doped when forming each of the shells of the core/shell type emulsions relating to the invention. The internal dopants include, for example, silver, sulfur, iridium, gold, platinum, osmium, rhodium, tellurium, selenium, cadmium, zinc, lead, thallium, iron, antimony, bismuth, arsenic and the like.

In order to dope the above-mentioned dopants, the water-soluble salts or the complex salts thereof may be present together when each of the shells is formed.

To serve as the binders or the dispersion meadia for producing the core/shell type silver halide grains relating to the invention, there uses a hydrophilic colloid which is usually used in silver halide emulsions. Such hydrophilic colloids, which may be used independently or in combination, include not only a gelatin (either of the lime-processed and the acid-processed) but also a gelatin derivative including those prepared through the reaction of gelatin with an aromatic sulfonyl chloride, an acid chloride, an acid anhydride, an isocyanate or a 1,4-diketone as described in U.S. Pat. No. 2,614,928, those prepared through the reaction of gelatin with a trimetallic acid anhydride as described in U.S. Pat. No. 3,118,766, those prepared through the reaction of gelatin with an organic acid having an active halogen as described in Japanese Patent Examined Publication No. 5514/1964, those prepared through the reaction of gelatin with an aromatic glycidyl ether as described in Japanese Patent Examined Publication No. 26845/1967, those prepared through the reaction of gelatin with a maleimide, maleamic acid, an unsaturated aliphatic diamide or the like as described in U.S. Pat. No. 3,186,846, a sulfoalkylated gelatin as described in British Pat. No. 1,033,189, a gelatin-polyoxyalkylene derivative as described in U.S. Pat. No. 3,312,553, and the like; a high molecular compound grafted with gelatin including, for example, those in which vinyl monomers such as acrylic acid, methacrylic acid, the esters of the above-mentioned acrylic acid or methacrylic acid and a mono- or polyvalent alcohol, amide, acrylo- or methacrylonitrile, styrene and the like, are grafted independently or in combination with gelatin; a hydrophilic high molecular substance including, for example, a homopolymer comprising such a monomer as vinyl alcohol, N-vinylpyrolidone, hydroxyalkyl (metha)acrylate, (metha)acrylamide, N-substituted (metha)acrylamide or the like, or the copolymers thereof, a copolymer of the above-mentioned substances and (metha)acrylate, vinyl acetate, styrene or the like, and a copolymer of either one of the above-mentioned substances and maleic anhydride, maleamic acid or the like; and a natural hydrophilic high molecular substance other than gelatin, such as casein, agar, alginic polysaccharides and the like.

The photographic emulsion to be used in this invention, in order to prevent the possible occurrence of fog in the course of the manufacture, storage or photographic processing of the photographic material or to stabilize the photographic characteristics, may contain various compounds such as those known as antifoggants or stabilizers, examples of which include thiazoles such as benzothiazolium salts, nitroindazoles, triazoles, benzotriazoles, benzimidazoles (particularly nitro- or halogen-substituted products); heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole), mercaptopyridines; the above heterocyclic mercapto compounds having water-soluble groups such as carboxyl group, sulfone group, etc.; thioketo compounds such as oxazolinethione; azaindenes such as tetrazaindenes (particularly 4-hydroxy-substituted (1,3,3a,7)tetrazaindenes); benzenethiosulfonic acids; benzenesulfinic acid; and the like. Regarding further detailed examples and uses of these compounds, reference can be made to, e.g., U.S. Pat. Nos. 3,954,474, 3,982,947, 4,021,248, and Japanese Patent Examined Publication No. 28660/1977.

The photographic emulsion layer of this invention or other hydrophilic colloid layers may contain various surfactants as the coating aid, antistatic agent or for the purpose of improving the slidability, effecting the emulsificiation-dispersion, improving the antiadhesion and photographic characteristics (such as development acceleration, hardening, sensitization), and the like.

Usable examples of such surfactants include nonionic surfactants such as e.g., saponin (steroid type), alkylene oxide derivatives (such as polyethylene glycol, polyethylene glycol/polypropylene glycol compounds, polyethylene glycol-alkyl ethers, or polyethylene glycol-alkylaryl ethers, polyethylene glycol esters, polyethylene glycol sorbitan esters, polyalkylene glycol alkylamines or amides, silicon's polyethylene oxide adducts), glycidol derivatives (such as alkenyl succinic acid polyglyceride, alkylphenol polyglyceride), fatty acid esters of polyhydric alcohols, alkyl esters of sugar, and the like; anionic surfactants containing acid groups such as carboxy group, sulfo group, phospho group, sulfuric acid ester group, phosphoric acid ester group, etc., such as alkyl carboxylates, alkyl sulfonates, alkylbenzene sulfonates, alkyl naphthalene sulfonates, alkyl sulfates, alkyl phosphates, N-acyl-N-alkyl-taurines, sulfosuccinates, sulfoalkylpolyoxyethylene-alkylphenyl ethers, polyoxyethylenealkyl phosphates, and the like; amphoteric surfactants such as amino acids, aminoalkylsulfonic acids, aminoalkyl sulfates or phosphates, alkylbetaines, amine oxides, and the like; and cationic surfactants such as alkylamine salts, aliphatic or aromatic quaternary ammonium salts, heterocyclic quaternary ammonium salts such as pyridinium, imidazolium, etc., aliphatic or heterocyclic ring-containing phosphonium or sulfonium salts, and the like.

The photographic emulsion layer of the photographic material of this invention, for the purpose of increasing the sensitivity and contrast or of development acceleration, may also contain, for example, polyalkylene oxides or derivatives thereof such as ethers, esters, amines, etc., thioether compounds, thiomorpholines, quaternary ammonium compounds, urethane derivatives, urea derivatives, imidazole derivatives, 3-pyrazolidones, or the like. For example, those as described in, e.g., U.S. Pat. Nos. 2,400,532, 2,423,549, 2,716,062, 3,617,280, 3,772,021, 3,808,003, British Pat. No. 1,488,991, and the like, may be used.

The photographic material of this invention, for the purpose of improving the dimensional stability of the photographic emulsion layer or other hydrophilic colloid layers, may contain water-insoluble or water-less-soluble synthetic polymer-dispersed materials. For example, those polymers may be used which are obtained by the homo- or copolymerization of such monomeric units as alkyl (meth)acrylates, alkoxyalkyl (meth)acrylates, glycidyl (meth)acrylates, (meth)acrylamides, vinyl esters (such as vinyl acetate), acrylonitrile, olefins, styrenes, etc., or those units in combination of these with acrylic acid, methacrylic acid, $\alpha,\beta$-unsaturated dicarboxylic acid, hydroxyalkyl (meth)acrylates, sulfoalkyl (meth)acrylates, styrenesulfonic acid, and the like. For example, those as described in U.S. Pat. Nos. 2,376,005, 2,739,137, 2,853,457, 3,062,674, 3,411,911, 3,488,708, 3,525,620, 3,607,290, 3,635,715 and 3,645,740, and British Pat. Nos. 1,186,699 and 1,307,373, may be used.

To the photographic processing of the photographic emulsion layer of this invention may be applied any of those known methods and known processing solutions as described in, e.g., Research Disclosure No. 176, p. 28~30 (RD-17643). This photographic processing may, if necessary, be a photographic processing to form a dye image (color photographic processing). The processing is made usually at a temperature between 18° C. and 50° C., but may also be made at a temperature of less than 18° C. or exceeding 50° C.

As a specific form of the processing, there may be used a method in which a developing agent is incorporated into the photographic material, for example, into the emulsion layer, and this photographic material is processed in an aqueous alkaline solution to thereby develop the same. Of developing agents hydrophobic ones may be incorporated into the emulsion layer in accordance with any of those various methods as described in Research Disclosure No. 169 (RD-16928), U.S. Pat. No. 2,739,890, British Pat. No. 813,253, West German Pat. No. 1,547,763, and the like. Such the developing process may take place in combination with a silver salt stabilizing process using a thiocyanate.

As the fixer solution those of generally used compositions may be used. As the fixing agent, in addition to thiosulfates and thiocyanates, those organic sulfur compounds known for their effects as the fixing agent may be used. The fixer solution may contain a water-soluble aluminum salt as a hardener.

The formation of a dye image can be carried out in usual manner; for example, those negative-positive methods as described in, e.g., 'Journal of the Society of Motion Picture and Television Engineers', vol. 61 (1953), p. 667~701, may be used.

A color developer solution is generally an aqueous alkaline solution containing a color developing agent. Usable examples of the color developing agent are those generally known aromatic amine developing agents including, e.g., phenylenediamines (such as 4-amino-N',N-diethylaniline, 3-methyl-4-amino-N',N-diethylaniline, 4-amino-N-ethyl-N-$\beta$-hydroxyethylaniline, 3-methyl-4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, and the like).

In addition, those as described in L.F.A. Mason, 'Photographic Processing Chemistry' (Focal Press, 1966), p. 226–229, U.S. Pat. Nos. 2,193,015 and 2,592,364, Japanese Patent O.P.I. Publication No. 64933/1973 may also be used.

The color developer solution may contain additionally pH buffer, development restrainer or antifoggant and the like, and, if necessary, may further contain hardener, softener, preservative, organic solvent, development accelerator, color-forming couplers, competing couplers, fogging agent, auxiliary developing agent, viscosity-giving agent, polycarboxylic acid-type chelating agent, oxidation inhibitor, and the like.

Examples of these additives are described in Research Disclosure (RD-17643), U.S. Pat. No. 4,083,723, West German OLS Patent No. 2,622,950, and the like.

The photographic emulsion layer, after color development, is usually bleached. The bleach treatment may take place either simultaneously with or separately from the fixing process. Examples of the bleaching agent for use in the bleaching process include compounds of polyvalent metals such as iron (III), cobalt (III), chromium (IV), copper (II), etc., peroxides, quinones, nitroso compounds, and the like, such as, e.g., ferricyanides; bichromates; organic complex salts of iron (III) or cobalt (III), e.g., those complex salts of organic acids including aminopolycarboxylic acids such as ethylenediaminetetraacetic acid, nitrilotriacetic acid, 1,3-diamino-2-propanoltetraacetic acid, etc., or citric acid, succinic acid, malic acid, etc.; persulfates, permanganates; nitrosophenol; and the like. Among these compounds, potassium ferricyanide, iron(III)-sodium ethylenediaminetetraacetate and iron(III)-ammonium ethylenediaminetetraacetate are especially useful. These complex salts of iron(III) ethylenediaminetetraacetate are useful not only for an independent bleaching bath but also for a bleach-fix monobath.

To the bleaching bath or bleach-fix bath may be added various additives including those bleaching accelerators described in U.S. Pat. Nos. 3,042,520 and 3,241,966, Japanese Patent Examined Publication Nos. 8506/1970 and 8836/1970, and those thiol compounds as described in Japanese Patent O.P.I. Publication No. 65732/1978.

The photographic emulsion of this invention may be spectrally sensitized by use of methine dyes or other dyes. For example, those compounds which will be hereinafter described in detail as sensitizing dyes in the examples of this invention may be used. Useful sensitizing dyes are those described in, e.g., West German Pat. No. 929,080, U.S. Pat. Nos. 2,493,748, 2,503,776, 2,519,001, 2,912,329, 3,656,959, 3,672,897 ans 4,025,349, British Pat. No. 1,242,588, and Japanese Patent Examined Publication No. 14030/1969.

These sensitizing dyes, although usable in usual manner, may be used in combination, and the combined use of sensitizing dyes is often utilized for the purpose of color sensitization. Representative examples of the combined use are described in U.S. Pat. Nos. 2,688,545, 2,977,229, 3,397,060, 3,522,052, 3,527,641, 3,617,293, 3,628,964, 3,666,480, 3,672,898, 3,679,428, 3,814,609 and 4,026,707, British Pat. No. 1,344,281, Japanese Patent Examined Publication Nos. 4936/1968 and 12375/1978, and Japanese Patent O.P.I. Publication Nos. 110618/1977 and 109925/1977.

The present invention applies also to a multilayer multicolor photographic material comprising a support having thereon at least two different spectral sensitivity-having layers. The multilayer color photographic material has normally on the support thereof at least one each red-sensitive emulsion layer, green-sensitive emulsion layer and blue-sensitive emulsion layer. The order of these layers may be arbitrarily selected at need. It is the normal way to incorporate a cyan-forming coupler into the red-sensitive emulsion layer, a magenta-forming coupler into the green-sensitive emulsion layer and an yellow-forming coupler into the blue-sensitive emulsion layer, but the combination may be changed otherwise if circumstances require.

This invention allows the use of an exposure shorter than 1/1000 second, not to speak of the exposure period of from 1/1000 to one second; for example, not only an exposure as short as $1/10^4 \sim 1/10^6$ second but also an exposure longer than one second may be used. If necessary, a color filter may be used to control the spectral composition of a light to be used in exposure. The exposure of the photographic material of this invention may be made with a laser light, or may also be made with rays released from a phosphor excited by electron beam, X rays, $\gamma$ rays, $\alpha$ rays, or the like.

The emulsion layer may contain a color-correction effect-having colored coupler or a coupler capable of releasing a development inhibitor in the course of development (DIR coupler), and may also contain an additional colorless DIR coupling compound, whose coupling reaction product is colorless and which releases a development inhibitor. Usable examples of the colored coupler include those as described in, e.g., U.S. Pat. Nos. 3,476,560, 2,521,908 and 3,034,892, Japanese Patent Examined Publication Nos. 2016/1969, 22335/1963, 11304/1967 and 32461/1969, Japanese Patent O.P.I. Publication Nos. 26034/1976 and 42121/1977, and West German OLS Patent No. 2,415,959. And usable examples of the DIR coupler include those as described in, e.g., U.S. Pat. Nos. 3,227,554, 3,617,291, 3,701,783, 3,790,384 and 3,632,345, West German OLS Patent Nos. 2,414,006, 2,454,301 and 2,454,329, British Pat. No. 953,454, Japanese Patent O.P.I. Publication Nos. 69624/1977 and 122335/1974, and Japanese Patent Examined Publication No. 16141/1976.

Besides the DIR coupler, the photographic material may also contain a compound capable of releasing a development inhibitor in the course of development, and examples of the compound include those as described in, e.g., U.S. Pat. Nos. 3,297,445 and 3,379,529, West German OLS Patent No. 2,417,914, and Japanese Patent O.P.I. Publication Nos. 15271/1977 and 9116/1978.

The photographic material of this invention may contain an inorganic or organic hardener in the photographic emulsion layer and other hydrophilic colloid layers thereof. For example, chromium salts (such as chrome alum, chromium acetate), aldehydes (such as formaldehyde, glyoxal, glutaraldehyde), N-methylol compounds, dimethylol urea, methyloldimethylhydantoin), dioxane derivatives (such as 2,3-dihydroxydioxane), active vinyl compounds (such as 1,3,5-triacryloylhexahydro-s-triazine, 1,3-vinylsulfonyl-2-propanol), active halogen compounds (such as 2,4-dichloro-6-hydroxy-s-triazine), mucohalogenic acids (such as mucochloric acid, mucophenoxychloric acid), and the like, may be used alone or in combination.

In the photographic material of this invention, where the hydrophilic colloid layer contains a dye or ultraviolet absorbing agent, these may be mordanted by a cationic polymer or the like; for example, those polymers as described in British Pat. No. 685,475, U.S. Pat. Nos. 2,675,316, 2,839,401, 2,882,156, 3,048,487, 3,184,309 and 3,445,231, West German OLS Patent No. 1,914,362, Japanese Patent O.P.I. Publication Nos. 47624/1975, 71332/1975, and the like.

The photographic material of this invention may contain an anticolor-stain agent. Examples of the agent include hydroquinone derivatives, aminophenol derivatives, gallic acid derivatives, and the like.

The photographic material of this invention may contain an ultraviolet absorbin agent in the hydrophilic layer thereof. For example, aryl group-substituted benzotriazole compounds, 4-thiazolidone compounds, benzophenone compounds, cinnamic acid ester compounds, butadiene compounds, benzoxazole compounds, and further ultraviolet absorbing polymers, and the like may be used. Any of these ultraviolet absorbing agents may be fixed to the above-mentioned hydrophilic colloid layer. Examples of such ultraviolet absorbing agents are described in U.S. Pat. Nos. 3,533,794, 3,314,794 and 3,352,681, Japanese Patent O.P.I. Publication No. 2784/1971, U.S. Pat. Nos. 3,705,805, 3,707,375, 4,045,229, 3,700,455 and 3,499,762, West German DAS Patent No. 1,547,863, and the like.

The photographic material of this invention may contain in the hydrophilic colloid layer thereof a water-soluble dye as a filter dye or for the purpose of anti-irradiation or for various other purposes. Examples of such dyes include oxonol dyes, hemioxonol dyes, styryl dyes, merocyanine dyes, cyanine dyes, and azo dyes. Of these the oxonol dyes, hemioxonol dyes and merocyanine dyes are useful.

In practicing the present invention, any of the following known antidiscoloration agents may be used in combination, and those dye image stabilizer applicable to this invention may be used alone or in combination of two or more. Examples of the prior-art antidiscoloration agents include hydroquinone derivatives, gallic acid derivatives, p-alkoxyphenols, p-oxyphenol derivatives, bisphenols, and the like. Examples of the hydroquinone derivatives are described in U.S. Pat. Nos. 2,360,290, 2,418,613, 2,675,314, 2,701,197, 2,704,713, 2,728,659, 2,732,300, 2,735,765, 2,710,801 and 2,816,028, and British Pat. No. 1,363,921; those of the gallic acid derivatives are described in U.S. Pat. Nos. 3,457,079, 3,069,262, etc.; those of the p-alkoxyphenols are described in U.S. Pat. Nos. 2,735,765 and 3,698,909, Japanese Patent Examined Publication Nos. 20977/1974 and 6623/1977; those of the p-oxyphenol derivatives are described in U.S. Pat. Nos. 3,432,300, 3,573,050, 3,574,627 and 3,764,337, Japanese Patent O.P.I. Publication Nos. 35633/1977, 147434/1977 and 152225/1977; and those of the bisphenols are described in U.S. Pat. No. 3,700,455.

The silver halide photographic material of this invention is prepared by coating on a support silver halide emulsion layers and other component layers containing various necessary photographic additives as described above. Advantageously usable examples of the support include, e.g., baryta paper, polyethylene-laminated paper, polypropylene synthetic paper, glass plates, cellulose acetate film, cellulose nitrate film, polyvinyl acetal film, polypropylene film, polyester film such as of polyethylene terephthalate, polystyrene film, and the like. These support materials may be arbitrarily selected to be used according to the purpose for which the silver halide photographic material is used.

These support materials are subjected to subbing treatment at need.

EXAMPLES

The present invention will be further illustrated in detail by the following examples. In all the following examples, the adding quantity of each material to the silver halide color photographic material is shown in a quantity per $m^2$. In addition, the silver halide and colloidal silver used are shown in silver equivalent.

<Example 1>

Samples of the color photosensitive materials were prepared in manner that on a subbed cellulose triacetate film support (BS) are coated in order from the support side the following RL-1, RH-1, IL, GL-1, GH-1, YF, BL-1, BH-1 and Pro layers.

Red-Sensitive Silver Halide Low-Speed Emulsion Layer (RL-1):

A red-sensitive silver halide low-speed emulsion layer containing 1.8 g of a monodisperse emulsion comprising AgBrI containing 6 mole% AgI, whose average grain size ($\gamma$) is 0.61 $\mu$m (EM I) and which is red-sensitized, and a dispersion product prepared by emulsifiedly dispersing into an aqueous solution of 1.85 g of gelatin a solution prepared by dissolving 0.2 g of 1-hydroxy-4-(isopropylcarbamoyl-methoxy)-N-[δ-(2,4-di-t-amylphenoxy)-butyl]-2-naphthamide (called C-1), 0.07 g of disodium 1-hydroxy-4-[4-(1-hydroxy-8-acetamido-3,6-disulfo-2-naphthylazo)-phenoxy]-N-[δ-(2,4-di-t-amylphenoxy)butyl]-2-naphthamide (called CC-1), 0.8 g of 1-hydroxy-2-[δ-(2,4-di-t-amylphenoxy)-n-butyl]naphthamide (called C-2), and 0.01 g of the hereinafter mentioned DIR compound (D-1) into 0.5 g of tricresyl phosphate (called TCP).

Red-Sensitive Silver Halide High-Speed Emulsion Layer (RH-1):

A red-sensitive silver halide high-speed emulsion layer containing 2.0 g of a monodisperse emulsion comprising AgBrI containing 6 mole% AgI, whose average grain size is 0.9 $\mu$m (EM II) and which is red-sensitized, and a dispersion product prepared by dispersing into an aqueous solution of 1.2 g of gelatin a solution of 0.20 g of cyan coupler (C-1) and 0.03 g of colored cyan coupler (CC-1) dissolved into 0.23 g of TCP.

Green-Sensitive Silver Halide Low-Speed Emulsion Layer (GL-1):

A green-sensitive silver halide low-speed emulsiom layer containing 1.5 g of EM I sensitized to be green-sensitive and a dispersion product prepared by emulsifiedly dispersing into an aqueous solution of 1.4 g of gelating a solution of 0.65 g of 1-(2,4,6-trichlorophenyl)-3-[3-(p-dodecyloxybenzenesulfonamido)benzamido]5-pyrazolone (called M-1), 0.15 g of 1-(2,4,6-trichlorophenyl)-4-(1-naphthylazo)-3-(2-chloro-5-octadecenylsuccinimidoanilino)-5-pyrazolone (called CM-1), and 0.03 g of DIR compound (D-1) dissolved into 0.68 g of TCP.

Green-Sensitive Silver Halide High-Speed Emulsion Layer (GH-1):

A green-sensitive silver halide high-speed emulsion layer containing 2.2 g of EM II sensitized to be green-sensitive and a dispersion product prepared by emulsifiedly dispersing into an aqueous solution of 1.9 g of gelatin a solution of 0.22 g of magenta coupler (M-1) and 0.045 g of colored magneta coupler (CM-1) dissolved into 0.27 g of TCP.

Blue-Sensitive Silver Halide Low-Speed Emulsion Layer (BL-1):

A blue-sensitive silver halide low-speed emulsion layer containing 0.8 g of EM I sensitized to be blue-sensitive and a dispersion product prepared by emulsifiedly dispersing into an aqueous gelatin solution a solution of the yellow coupler given in Table 1 and 0.01 g of DIR compound (D-1) dissolved into TCP.

Blue-Sensitive Silver Halide High-Speed Emulsion Layer (BH-1):

A blue-sensitive silver halide high-speed emulsion layer containing an emulsion sensitized to be blue-sensitive comprising AgBrI containing 8 mole% AgI and having an average grain size of 1.0 $\mu$m and a coefficient of variation of 0.14 and a dispersion product prepared by emulsifiedly dispersing into an aqueous gelating solution a solution of of the yellow coupler dissolved into TCP.

Interlayer (IL):

An interlayer containing 0.8 g of gelatin.

Yellow Filter Layer (YF):

An yellow filter layer containing 0.15 g of yellow colloidal silver and 1.0 g of gelatin.

Protective layer (Pro):

A protective layer containing 2.3 g of gelatin.

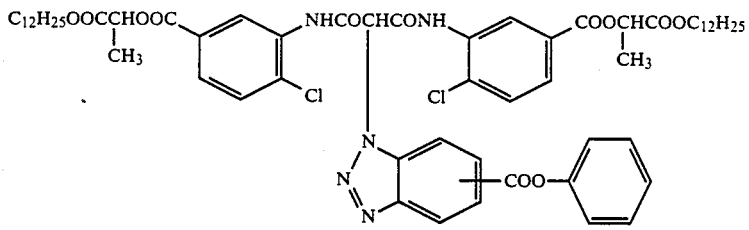

DIR Compound D-1

A plurality of samples were prepared in the above manner, varying the amount of oil (sum of the quantities of the yellow coupler and TCP) and the amount of gelatin contained in the low-speed blue-sensitive layer (BL-1) and high-speed blue-sensitive layer (BH-1) as shown in Table 1.

TABLE 1

| Sample No. | BH-1 Yellow coupler | BH-1 Amount of oil | BH-1 Amount of gel | BH-1 Dry thickness | BL-1 Yellow coupler | BL-1 Amount of oil | BL-1 Amount of gel | BL-1 Dry thickness | Sum (μ) of dry thickness | silver density (g/cm²) | |
|---|---|---|---|---|---|---|---|---|---|---|---|
| 1 | Y-2 | 0.69 | 2.00 | 2.40 | Y-2 | 0.86 | 0.78 | 1.71 | 4.11 | 0.438 | Comparative |
| 2 | Y-2 | 0.69 | 0.73 | 1.48 | Y-2 | 0.86 | 2.00 | 2.60 | 4.08 | 0.441 | " |
| 3 | Y-2 | 0.69 | 2.00 | 2.40 | Y-2 | 0.86 | 2.00 | 2.60 | 5.00 | 0.360 | " |
| 4 | Y-2 | 0.69 | 1.50 | 2.02 | Y-2 | 0.86 | 1.50 | 2.24 | 4.26 | 0.390 | " |
| 5 | Y-2 | 0.69 | 0.73 | 1.48 | Y-2 | 0.86 | 0.78 | 1.71 | 3.19 | 0.564 | Invention |
| 6 | Y-2 | 0.69 | 0.73 | 1.46 | Y-2 | 0.86 | 0.78 | 1.68 | 3.15 | 0.527 | " |
| 7 | Y'-1 | 0.60 | 0.73 | 1.39 | Y-2 | 0.86 | 0.78 | 1.71 | 3.19 | 0.598 | " |
| 8 | Y'-1 | 0.60 | 0.73 | 1.39 | Y'-1 | 0.75 | 0.78 | 1.60 | 2.99 | 0.602 | " |
| 9 | Y'-2 | 0.60 | 0.73 | 1.39 | Y'-2 | 0.75 | 0.78 | 1.60 | 2.99 | 0.602 | " |
| 10 | Y'-15 | 0.60 | 0.73 | 1.39 | Y'-15 | 0.75 | 0.78 | 1.60 | 2.99 | 0.602 | " |

Note:
The 'Amount of oil' is sum of the quantities of coupler and TCP.
The 'Amount of silver' is 1.66 g/m² for Samples No. 4 and No. 6, and 1.80 mg/m² for the other samples.
The 'Amount of oil' and the 'Amount of gel' are given in grams per m².

The thus prepared Samples No. 1~No. 12 each was exposed through an optical wedge to a white light, and then developed in the following processing steps:

| Processing steps (38° C.) | |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of the processing solutions used in the respective processes are as follows:

| | |
|---|---|
| [Color Developer Solution] | |
| 4-amino-3-methyl-N—ethyl-N—(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Water to make 1 liter. | |
| [Bleaching Bath] | |
| Iron-ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |
| Water to make 1 liter | |
| Use aqueous ammonia to adjust the pH to 6.0. | |
| [Fixer Solution] | |
| Ammonium thiosulfate | 175.0 g |

-continued

| | |
|---|---|
| Anhydrous sodium sulfite | 8.5 g |
| Sodium metasulfite | 2.3 g |
| Water to make 1 liter | |
| Use acetic acid to adjust the pH to 6.0 | |
| [Stabilizing Bath] | |
| Formalin (37% aqueous solution) | 1.5 ml |
| Koniducks (produced by Konishiroku Photo Industry Co., Ltd.) | 7.5 ml |
| Water to make 1 liter. | |

The obtained samples each was measured by use of a white light (W) with respect to fog, relative sensitivity (S), sharpness (MTF) and RMS. The results are shown in Table 2.

The relative sensitivity (S) is a relative value to the reciprocal of the exposure giving fog density +0.1, and shown with a value relative to the value of Sample No. 1 regarded as 100. Regarding the improvement effect of the sharpness, the MTF (Modulation Transfer Function) of the formed dye image is first found, and then the improvement effect is shown with a relative value (to Sample No. 1 regarded as 100) of the MTF at 10 lines/mm.

The RMS value is given with the 1000-fold value of the standard deviation of the variation of a density value obtained when scanning the minimum density +0.7 area by a microdensitometer having a 25 μm circulate scanning head.

In addition, the interimage improvement effect is shown with a relative value (to Sample No. 1 regarded as 100) of the proportion of the sensitometry $\gamma_B$ with blue light (B) to the sensitometry $\gamma_W$ with white light (W).

TABLE 2

| Sample No. | Fog | S | MTF | RMS | $\gamma_B/\gamma_W$ | |
|---|---|---|---|---|---|---|
| 1 | 0.60 | 100 | 100 | 43 | 100 | Comparative |
| 2 | 0.60 | 100 | 100 | 43 | 100 | " |

TABLE 2-continued

| Sample No. | Fog | S | MTF | RMS | $\gamma_B/\gamma_W$ | |
|---|---|---|---|---|---|---|
| 3 | 0.60 | 100 | 97 | 43 | 98 | " |
| 4 | 0.60 | 98 | 95 | 50 | 96 | " |
| 5 | 0.60 | 105 | 120 | 38 | 120 | Invention |
| 6 | 0.60 | 103 | 124 | 39 | 122 | " |
| 7 | 0.60 | 107 | 123 | 37 | 126 | " |
| 8 | 0.60 | 108 | 130 | 35 | 128 | " |
| 9 | 0.60 | 108 | 130 | 35 | 128 | " |
| 10 | 0.60 | 108 | 130 | 35 | 128 | " |

From the results shown in the above table, it is apparent that, where the Ag density is settled in accordance with this invention, the sharpness, graininess, sensitivity and interimage effect are improved.

<Example 2>

Samples were prepared in the same manner as in Example 1 except that the layer construction of Example 1 was changed to the following inverse layer construction:

From the support side, BS→RL-1→IL→GL-1→IL→BL-1→IL→RH-1→IL→GH-1→IL→BH-1→Pro.

The results are shown in Table 3. From the table it is apparent that any of the samples according to this invention shows very satisfactory results.

TABLE 3

| Sample No. | Fog | S | MTF | RMS | $\gamma_B/\gamma_W$ | |
|---|---|---|---|---|---|---|
| 1' | 0.60 | 100 | 100 | 41 | 100 | Comparative |
| 2' | 0.60 | 100 | 100 | 41 | 100 | " |
| 3' | 0.60 | 100 | 97 | 41 | 98 | " |
| 4' | 0.60 | 98 | 95 | 47 | 96 | " |
| 5' | 0.60 | 106 | 120 | 36 | 120 | Invention |
| 6' | 0.60 | 104 | 124 | 37 | 122 | " |
| 7' | 0.60 | 108 | 123 | 35 | 126 | " |
| 8' | 0.60 | 109 | 130 | 33 | 128 | " |
| 9' | 0.60 | 109 | 130 | 33 | 128 | " |
| 10' | 0.60 | 109 | 130 | 33 | 128 | " |

<Example 3>

The samples of Example 1 were compared in Table 4 with respect to their desilverizabilities at the time of bleaching. The judgement of the desilverizability was carried out by measuring the amount of the residual silver in the maximum density area of each processed sample. That the amount of the residual silver is large implies that the processability is inadequate. It is apparent from Table 4 that the samples according to this invention are excellent in the desilverizability.

TABLE 4

| Sample No. | | Residual silver (g/m²) |
|---|---|---|
| Comparative | 1 | 0.21 |
| | 2 | 0.21 |
| | 3 | 0.23 |
| | 4 | 0.20 |

TABLE 4-continued

| Sample No. | | Residual silver (g/m²) |
|---|---|---|
| Invention | 5 | 0.14 |
| | 6 | 0.10 |
| | 7 | 0.06 |
| | 8 | 0.06 |
| | 9 | 0.06 |
| | 10 | 0.06 |

<Example 4>

A sample was prepared in such a manner that the following layers, RL-1, RH-1, IL, GL-1, GH-1, YF, BL-1, BH-1 and Pro were coated in order upward from a support (BS) coated in advance with an antihalation layer.

Layer-1: An antihalation layer containing 0.4 g of black colloidal silver and 3.0 g of gelatin.

Layer-2: A low-speed layer (RL-1) of red-sensitive silver halide emulsion layers. The same as RL-1 in Example 1, except that this does not contain any DIR compound.

Layer-3: A high-speed layer (RH-1) of red-sensitive silver halide emulsion layers. The same as RH-1 in Example 1.

Layer-4: An interlayer containing 0.04 g of dibutyl phthalate (hereinafter called DBP) into which 0.07 g of Q-1 were dissolved, and 1.2 g of gelatin.

Layer-5: A low-speed layer (GL-1) of green-sensitive silver halide emulsion layers. The same as GL-1 in Example 1.

Layer-6: A high-speed layer (GH-1) of green-sensitive silver halide emulsion layers. The same as GH-1 in Example 1.

Layer-7: A yellow filter layer (YF). The same as YF in Example 1.

Layer-8: A low-speed layer (BL-1) of blue-sensitive silver halide emulsion layer. This layer contains 0.8 g of a blue-sensitized Emulsion I and a dispersed matter prepared in such a manner that 1.2 g of Exemplified Compound (Y-14) and 0.01 g of DIR compound were dissolved in 0.68 g of TCP and the resulted solution was emulsified and dispersed in an aqueous gelatin solution.

Layer-9: A high-speed layer (BH-1) of blue-sensitive silver halide emulsion layers. This layer contains 0.7 g of blue-sensitized emulsion comprising AgBrI containing AgI of 8 mol % and a dispersed matter prepared in such a manner that the Exemplified Compound (Y-14) was dissolved in 0.35 g of TCP and the resulted solution was emulsified and dispersed in an aqueous gelating solution.

Layer-10: A protective layer (Pro).

The same as Pro in Example 1.

Taking this sample prepared as above, the contents of the AS agent and gelatin in each of the low-speed blue-sensitive layer (BL-1) and high-speed blue-sensitive layer (BH-1) were changed as shown in Table 5. In the Table, 'amount' and 'layer thickness' are expressed by g and μm, respectively.

TABLE 5

| | BH-1 | | | | | BL-1 | | | | | Total | | |
|---|---|---|---|---|---|---|---|---|---|---|---|---|---|
| Sample No. | AS agent name | AS agent amount | Layer added with | Gel amount | Dried layer thickness | AS agent name | AS agent amount | Layer added with | Gel amount | Dried layer thickness | dried layer thickness | silver density | |
| 101 | Q-1 | 0.070 | 9 | 2.00 | 2.40 | Q-1 | 0.070 | 8 | 0.78 | 1.71 | 4.11 | 0.438 | Compar- |

TABLE 5-continued

| Sample No. | BH-1 AS agent name | BH-1 AS agent amount | BH-1 Layer added with | BH-1 Gel amount | BH-1 Dried layer thickness | BL-1 AS agent name | BL-1 AS agent amount | BL-1 Layer added with | BL-1 Gel amount | BL-1 Dried layer thickness | Total dried layer thickness | silver density | |
|---|---|---|---|---|---|---|---|---|---|---|---|---|---|
| 102 | " | " | " | 0.73 | 1.48 | " | " | " | 2.00 | 2.60 | 4.08 | 0.441 | ative Comparative |
| 103 | " | " | " | 2.00 | 2.40 | " | " | " | 2.00 | 2.60 | 5.00 | 0.360 | Comparative |
| 104 | " | " | " | 1.50 | 2.02 | " | " | " | 1.50 | 2.24 | 4.26 | 0.390 | Comparative |
| 105 | " | " | " | 0.73 | 1.48 | " | " | " | 0.78 | 1.71 | 3.19 | 0.564 | Invention |
| 106 | " | " | " | " | " | " | " | " | " | 1.68 | 3.15 | 0.527 | Invention |
| 107 | " | " | " | " | 1.39 | " | " | " | " | 1.71 | 3.19 | 0.598 | Invention |
| 108 | " | " | " | " | " | " | " | " | " | 1.60 | 2.99 | 0.602 | Invention |
| 109 | Q-6 | 0.061 | " | " | " | Q-6 | 0.061 | " | " | " | " | " | Invention |
| 110 | Q-15 | 0.053 | " | " | " | Q-15 | 0.053 | " | " | " | " | " | Invention |
| 111 | Q-19 | 0.034 | " | " | " | Q-19 | 0.034 | " | " | " | " | " | Invention |
| 112 | Q-23 | 0.065 | " | " | " | Q-23 | 0.065 | " | " | " | " | " | Invention |

Each of the Samples Nos. 101 through 113 prepared as mentioned above were exposed to white light through a wedge and were then processed in the same manner as in Example 1.

With respect to each of the samples thus processed, the relative sensitivity (S) and RMS thereof were measured by making use of blue light. The results thereof are shown in Table 5.

A relative senstivity (S) is a relative value to the reciprocal of an exposure capable of giving a fog density of +0.1, provided that the sensitivity of Sample No. 1 is regarded as a value of 100.

An RMS value expresses 1,000 times the standard deviation of a density value variation caused when scanning the three kinds of the minimum densities, namely, +0.5, +1.0, and +1.5, by making use of a microdensitometer having a round scanning aperture of 25 μm in diameter.

The results thereof are shown in Table 6.

TABLE 6

| Sample No. | S in blue-sensitive layer | RMS in blue-sensitive layer Dmin + 0.5 | Dmin + 1.0 | Dmin + 1.5 |
|---|---|---|---|---|
| 101 | 100 | 45 | 41 | 37 |
| 102 | 100 | 45 | 41 | 37 |
| 103 | 100 | 45 | 41 | 37 |
| 104 | 98 | 53 | 48 | 43 |
| 105 | 105 | 39 | 36 | 33 |
| 106 | 103 | 40 | 37 | 34 |
| 107 | 107 | 38 | 35 | 32 |

TABLE 6-continued

| Sample No. | S in blue-sensitive layer | RMS in blue-sensitive layer Dmin + 0.5 | Dmin + 1.0 | Dmin + 1.5 |
|---|---|---|---|---|
| 108 | 108 | 36 | 33 | 30 |
| 109 | 106 | 35 | 31 | 28 |
| 110 | 106 | 35 | 32 | 29 |
| 111 | 107 | 36 | 33 | 30 |
| 112 | 108 | 36 | 33 | 30 |

It is apparent from the results shown in Table 6 that, in the system having the dried layer thickness and silver density relating to the invention, the scavengers are especially effective and the RMS values are decreased particularly in a relatively greater exposure range, so that an image having an excellent graininess can be obtained.

<Example 5>

The samples were prepared in the same manner as in Example 4, except that the layer arrangements were changed into the inverted layer arrangements. (Refer to Table 7).

The layer arrangements were made in the following order from the lowest layer; namely, BS→RL→I→IL→GI→I→IL→BL→I→IL→RH→I→IL→GH→I→II→BH→I→Pro.

The results thereof are shown in Table 8 and every example prepared in accordance with the invention resulted excellently.

TABLE 7

| Sample No. | BH-1 AS agent name | BH-1 AS agent name | BH-1 Layer added with | BH-1 Gel amount | BH-1 Dried Layer thickness | BL-1 AS agent name | BL-1 AS agent name | BL-1 Layer added with | BL-1 Gel amount | BL-1 Dried layer thickness | Total dried layer thickness | silver density | |
|---|---|---|---|---|---|---|---|---|---|---|---|---|---|
| 301 | Q-1 | 0.07 | 12 | 2.00 | 2.40 | Q-1 | 0.07 | 6 | 0.78 | 1.71 | 4.11 | 0.438 | Comparative |
| 302 | " | " | " | 0.73 | 1.48 | " | " | " | 2.00 | 2.60 | 4.08 | 0.441 | " |
| 303 | " | " | " | 2.00 | 2.40 | " | " | " | 2.00 | 2.60 | 5.00 | 0.360 | " |
| 304 | " | " | " | 1.50 | 2.02 | " | " | " | 1.50 | 2.24 | 4.26 | 0.390 | " |
| 305 | " | " | " | 0.73 | 1.48 | " | " | " | 0.78 | 1.71 | 3.19 | 0.564 | Invention |
| 306 | " | " | " | " | " | " | " | " | " | 1.68 | 3.15 | 0.527 | " |

TABLE 7-continued

| Sample No. | BH-1 AS agent name | BH-1 AS agent name | BH-1 Layer added with | BH-1 Gel amount | BH-1 Dried Layer thickness | BL-1 AS agent name | BL-1 AS agent name | BL-1 Layer added with | BL-1 Gel amount | BL-1 Dried layer thickness | Total dried layer thickness | silver density | |
|---|---|---|---|---|---|---|---|---|---|---|---|---|---|
| 307 | " | " | " | " | 1.39 | " | " | " | " | 1.71 | 3.19 | 0.598 | " |
| 308 | " | " | " | " | " | " | " | " | " | 1.60 | 2.99 | 0.602 | " |
| 309 | " | " | " | " | 1.48 | " | " | 7 | " | 1.71 | 3.19 | 0.564 | " |
| 310 | " | " | " | " | " | " | " | " | " | 1.68 | 3.15 | 0.527 | " |
| 311 | " | " | " | " | 1.39 | " | " | " | " | 1.71 | 3.19 | 0.598 | " |
| 312 | " | " | " | " | " | " | " | " | " | 1.60 | 2.99 | 0.602 | " |
| 313 | Q-6 | 0.061 | " | 2.00 | " | Q-6 | 0.061 | 6 | " | " | " | " | " |
| 314 | Q-15 | 0.053 | " | " | " | Q-15 | 0.053 | " | " | " | " | " | " |
| 315 | Q-19 | 0.034 | " | " | " | Q-19 | 0.034 | " | " | " | " | " | " |
| 316 | Q-23 | 0.065 | " | " | " | Q-23 | 0.065 | " | " | " | " | " | " |
| 317 | Q-6 | 0.061 | " | " | " | Q-6 | 0.061 | 7 | " | " | " | " | " |
| 318 | Q-15 | 0.053 | " | " | " | Q-15 | 0.053 | " | " | " | " | " | " |
| 319 | Q-19 | 0.034 | " | " | " | Q-19 | 0.034 | " | " | " | " | " | " |
| 320 | Q-23 | 0.065 | " | " | " | Q-23 | 0.065 | " | " | " | " | " | " |

TABLE 8

| Sample No. | S | RMS Dmin + 0.5 | RMS Dmin + 1.0 | RMS Dmin + 1.5 |
|---|---|---|---|---|
| 301 | 100 | 44 | 40 | 36 |
| 302 | 100 | 44 | 40 | 36 |
| 303 | 100 | 45 | 40 | 37 |
| 304 | 98 | 51 | 46 | 42 |
| 305 | 105 | 37 | 34 | 30 |
| 306 | 103 | 38 | 35 | 31 |
| 307 | 107 | 37 | 34 | 30 |
| 308 | 108 | 35 | 32 | 29 |
| 309 | 105 | 33 | 30 | 27 |
| 310 | 103 | 33 | 31 | 28 |
| 311 | 107 | 34 | 32 | 28 |
| 312 | 108 | 34 | 33 | 30 |
| 313 | 108 | 33 | 33 | 30 |
| 314 | 109 | 35 | 33 | 30 |
| 315 | 109 | 37 | 34 | 30 |
| 316 | 109 | 37 | 34 | 30 |
| 317 | 108 | 37 | 34 | 30 |
| 318 | 108 | 37 | 34 | 30 |
| 319 | 109 | 37 | 34 | 30 |
| 320 | 108 | 36 | 35 | 31 |

<Example 6>

(1) Preparation of a silver halide emulsion:

The seed grains of a silver halide and an aqueous gelating solution were put into a reaction vessel in advance and while the pAg and pH values of the contents thereof were kept controlled, and there were added with an aqueous ammoniacal silver nitrate solution, an aqueous potassium iodobromide solution (1) and an aqueous potassium iodobromide solution (2-1) containing relatively less potassium iodide than the solution (1) or an aqueous potassium bromide solution (2-2), in proportion to the increases of the grain surface areas in the course of growing the grains and were further continuously added with the solution (2-1) or (2-2) with increasing the proportion thereof to the solution (1) when the grain size became suitable. There were some instances where the proportion increases of the solution (2-1) or (2-2) to the solution (1) were made two-stepwise. Next, an queous solution of Demol-N (manufactured by Kao-Atlas Company) and an aqueous magnesium sulfate solution were so added as to be precipitately desalted and a gelating was then added, so that an emulsion of 7.8 in pAg and 6.0 in pH value was obtained.

Further, sodium thiosulfate, chloroaurate and ammonium rhodanate were so added as to be chemically ripened and 4-hydroxy-6-methyl-1,3,3a,7-tetrazaindene and 6-nitrobenzimidazole and, further, gelatin were added, so that a core/shell type silver iodobromide emulsion was obtained.

Therein, the mol% of silver iodide was changed by changing the proportion of adding the solution (2-1) or (2-2) to the solution (1), the grain size was changed by changing the amounts added of ammoniacal silver nitrate and potassium halide, each thickness of the outermost and intermediate shells was changed by changing the grain size at the time when changing the proportion of adding the solution (2-1) or (2-2) to the solution (1) in the course of growing the silver halide grains, and further the crystal habit was changed by changing the pAg value in the course of the reaction, so that such a core/shell type silver iodobromide emulsion as Samples 1-1 through 7-2 were prepared, respectively, as shown in Table 9.

It was proved by an electron-microscopic observation that every sample emulsion shown in Table 9 is a monodisperse type emulsion having the average grain size and grain size distribution shown in Table 9.

TABLE 9

| Sample Emulsion | Ih mol % | Im mol % | Il mol % | ΔI = Ih − Il mol % | ΔI = Ih − Im mol % | ΔI = Im − Il mol % | Total amount of iodide mol % | Volume of each shell Vh % | Volume of each shell Vm % | Volume of each shell Vl % | Average grain size μm | Variation coefficient % |
|---|---|---|---|---|---|---|---|---|---|---|---|---|
| 1-1 | 15 | 5 | 0.3 | 14.7 | 10 | 4.7 | 5.6 | 22 | 39 | 27 | 0.38 | 12 |
| 1-2 | " | " | " | " | " | " | " | " | " | " | 0.55 | 11 |
| 2-1 | 15 | 5 | 0.3 | 14.7 | 13 | 1.7 | 4.4 | " | " | " | 0.38 | 11 |
| 2-2 | " | " | " | " | " | " | " | " | " | " | 0.55 | 11 |
| 3-1 | 8 | 4 | 0.3 | 7.7 | 4 | 3.7 | 3.7 | " | " | " | 0.38 | 11 |
| 3-2 | " | " | " | " | " | " | " | " | " | " | 0.55 | 10 |
| 4-1 | 8 | 6 | 0.3 | 7.7 | 2 | 5.7 | 4.4 | " | " | " | 0.38 | 11 |
| 4-2 | " | " | " | " | " | " | " | " | " | " | 0.55 | 11 |
| 5-1 | 20 | 5 | 0.3 | 19.7 | 15 | 4.7 | 6.7 | " | " | " | 0.38 | 13 |

TABLE 9-continued

| Sample Emulsion | Ih mol % | Im mol % | Il mol % | ΔI = Ih − Il mol % | ΔI = Ih − Im mol % | ΔI = Im − Il mol % | Total amount of iodide mol % | Volume of each shell Vh % | Vm % | Vl % | Average grain size μm | Variation coefficient % |
|---|---|---|---|---|---|---|---|---|---|---|---|---|
| 5-2 | " | " | " | " | " | " | " | " | " | " | 0.55 | 11 |
| 6-1 | 40 | 5 | 0.3 | 39.7 | 35 | 4.7 | 11.1 | " | " | " | 0.38 | 18 |
| 6-2 | " | " | " | " | " | " | " | " | " | " | 0.55 | 16 |
| 7-1 | 15 | 10 | 5 | 10 | 5 | 5 | 8.8 | " | " | " | 0.38 | 13 |
| 7-2 | " | " | " | " | " | " | " | " | " | " | 0.55 | 12 |

<Example 7>

The following layers, namely, RL-1, RH-1, IL, GL-1, GH-1, YF, BL-1, BH-1 and Pro, were coated in order upward from the support (BS) coated thereon in advance with an antihalation layer.

A low-speed layer (RL-1) of red-sensitive silver halide emulsion layers:

This layer contains 1.8 g of an emulsion prepared by red-sensitizing the Emulsion EM 1-1 used in the Example 6 and a dispersed matter prepared in such a manner that 0.2 g of the cyan coupler C-1, 0.07 g of the cyan coupler CC-1, 0.8 g of the cyan coupler C-2 and 0.01 g of a DIR compound (D-1) were dissolved in 0.5 g of tricresyl phosphate (TCP) and the resulted solution was emulsified and dispersed in an aqueous solution containing 1.85 g of gelatin.

A high-speed layer (RH-1) of red-sensitive silver halide emulsion layers:

This layer contains 2.0 g of an emulsion prepared by red-sensitizing the Emulsion EM-1-2 used in Example 6 and a dispersed matter prepared in such a manner that 0.20 g of a cyan coupler (C-1) and 0.03 g of a colored cyan coupler (CC-1) were dissolved in 0.23 g of TCP, and the resulted solution was emulsified and dispersed in an aqueous solution containing 1.2 g of gelatin.

A low-speed layer (GL-1) of green-sensitive silver halide emulsion layer:

This layer contains 1.5 g of an emulsion prepared by green-sensitizing the Emulsion 1-1 and a dispersed matter prepared in such a manner that 0.65 g of the magenta coupler M-1, 0.15 g of the magenta coupler CM-1 and 0.03 g of a DIR compound (D-1) were dissolved in 0.68 g of TCP, and the resulted solution was emulsified and dispersed in an aqueous solution containing 1.4 g of gelatin.

A high-speed layer (GH-1) of green-sensitive silver halide emulsion layer:

This layer contains 2.0 g of an emulsion prepared by green-sensitizing the Emulsion 1-2 and a dispersed matter prepared in such a manner that 0.22 g of magenta coupler (M-1) and 0.045 g of colored magenta coupler (CM-1) were dissolved in 0.27 g of TCP, and the resulted solution was emulsified and dispersed in an aqueous solution containing 1.9 g of gelatin.

A low-speed layer (BL-1) of blue-sensitive silver halide emulsion layer:

This layer contains 0.88 g of an emulsion prepared by blue-sensitizing the Emulsion 1-1 and a dispersed matter prepared in such a manner that 1.2 g of the Exemplified yellow coupler Y-14 and 0.01 g of a DIR compound (D-1) were dissolved in 0.68 g of TCP, and the resulted solution was emulsified and dispersed in an aqueous gelatin solution.

A high-speed layer (BH-1) of blue-sensitive silver halide emulsion layer:

This layer contains 0.7 g of an emulsion prepared by blue-sensitizing the Emulsion EM-1-2 and a dispersed matter prepared in such a manner that the above-mentioned yellow coupler was dissolved in 0.35 g of TCP and the resulted solution was emulsified and dispersed in an aqueous gelatin solution.

An interlayer (IL):

This layer contains 0.8 g of gelatin and 0.07 g of dibutyl phthalate (DBP) into which 0.07 g of 2,5-di-t-octyl hydroquinone (HQ-1) were dissolved.

A yellow filter layer (YF):

This layer contains 0.15 g of yellow colloidal silver, 0.11 g of DBP dissolved therein with 0.2 g of a color-stain inhibitor (HQ-1) and 1.0 g of gelatin.

Protective layer (Pro):

This layer contains 2.3 g of gelatin.

The Samples No. 501 through No. 509 each shown in Table 10 were prepared in such a manner that, in the Sample No. 1 prepared as above, the silver halide grains contained in the Emulsions BL-1 and BH-1 were changed to those indicated in Table 1 and the contents of the gelatin and the silver halide emulsions of the Emulsions BL-1 and BH-1 were so changed as to be the values of the silver halide contents, dried layer thickness and silver density of each layer, respectively, as shown in Table 10.

The respective samples were exposed through a wedge in an ordinary method for measuring the sensitometric characteristics such as sensitivity, exposure range and fogginess and the graininess thereof, and were exposed through a square wave frequency wedge for measuring the sharpness thereof, and were then developed in the same manner as in Example 1.

The sensitometry, graininess and sharpness of the developed samples were measured by exposing them to blue-light, respectively.

Sensitometry . . .

A relative value of the reciprocal of an exposure (in the terms of an antilogarithmic value) capable of endowing the samples with an optical density having a fog +0.1 on the characteristic curves. It is preferred when the values are geater, because the greater the values are, the faster the sensitivities are.

Sharpness . . .

The improvement effects on the sharpness of an image were checked up by obtaining the MTF (i.e., Modulation Transfer Function) and comparing each of the degrees of the MTF of the samples, in which the spatial frequencies are 10 lines/mm. The greater the values are, the better the sharpness is.

Graininess . . .

An RMS value expresses 1,000 times the standard deviation of a density value variation caused when scanning a dye image having the minimum density of 0.8 by making use of a microdensitometer having a round scanning aperture of 25 μm in diameter, provided that the value of a control sample is relatively regarded as 100. It is not preferred when the values are greater, because the greater the values are, the coarser the graininess is.

Exposure range . . .

When obtaining the difference, on a characteristic curve, between an exposure (in terms of a logarithmic value) capable of endowing the samples with an optical density having a fog of +0.1 and an exposure (in terms of a logarithmic value) capable of endowing the samples with a maximum optical density of −0.1, it is preferred when the difference is greater, because the greater the difference is, the wider the exposure range is.

TABLE 10

| Sample No. | Sample emulsion BL-1 | Sample emulsion BH-1 | Silver halide amount (g/m³) | Dried layer thickness (μm) | Silver density d(g/cm³) | S B | RMS B | MTF B | Exposure range |
|---|---|---|---|---|---|---|---|---|---|
| 501 (Invention) | 1-1 | 1-2 | 1.58 | 3.5 | $4.5 \times 10^{-1}$ | 140 | 42 | 51 | 1.28 |
| 502 (Invention) | 2-1 | 2-2 | " | " | " | 120 | 45 | 53 | 1.15 |
| 503 (Invention) | 3-1 | 3-2 | " | " | " | 130 | 45 | 55 | 1.10 |
| 504 (Invention) | 4-1 | 4-2 | " | " | " | 110 | 46 | 55 | 1.22 |
| 505 (Invention) | 5-1 | 5-2 | " | " | " | 145 | 40 | 51 | 1.31 |
| 506 (Invention) | 6-1 | 6-2 | " | " | " | 140 | 42 | 51 | 1.35 |
| 507 (Invention) | 7-1 | 7-2 | " | " | " | 130 | 45 | 49 | 1.27 |
| 508 (Other than Invention) | 1-1 | 1-2 | " | 5.0 | $3.15 \times 10^{-1}$ | 130 | 42 | 43 | 1.27 |
| 509 (Other than Invention) | 1-1 | 1-2 | " | 7.5 | $2.1 \times 10^{-1}$ | 135 | 41 | 39 | 1.24 |

It is understood from the results shown in the above table that all the results can be improved when using a core/shell type emulsion and prescribing the density of Ag in accordance with the invention.

<Example 8>

The samples were prepared in the same manner as in Example 7, except that the layer arrangements were changed to the following inversed layer arrangements.

In order from the lowest layer, BS→RL→1→IL→GL→1→IL→BL→1→IL→RH→1→IL→GH→1→IL→BH→1→→Pro.

The results thereof are shown in Table 11. Every samples according to the invention resulted excellently.

TABLE 11

| Sample No. | Sample emulsion BL-1 | Sample emulsion BH-1 | Silver halide amount (g/m³) | Dried layer thickness (μm) | Silver density d(g/cm³) | S B | RMS B | MTF B | Exposure range |
|---|---|---|---|---|---|---|---|---|---|
| 601 (Invention) | EM-1-1 | EM-1-2 | 1.58 | 3.5 | $4.5 \times 10^{-1}$ | 145 | 49 | 49 | 1.26 |
| 602 (Other than Invention) | EM-2-1 | EM-2-2 | " | 5.0 | $3.15 \times 10^{-6}$ | 130 | 47 | 39 | 1.30 |
| 603 (Other than Invention) | EM-1-1 | EM-1-2 | " | 7.5 | $2.1 \times 10^{-1}$ | 135 | 46 | 35 | 1.23 |

What is claimed is:

1. A silver halide photographic material comprising at least one blue-sensitive silver halide emulsion layer, silver density (d) expressed in terms of the following equation $$d=N/V$$

(wherein, N is the amount of silver contained in said emulsion layer in term of gram and V is the volume of said blue-sensitive emulsion layer in term of cm³) of said emulsion layer being $4.0\times10^{-1}$ g/cm³ to 1.2 g/cm³ and the dry-thickness of said emulsion layer being 0.8 μm to 4.0 μm.

2. The silver halide photographic material of claim 2, wherein said density of silver d is within the range of from $5.0\times10^{-1}$ g/cm³ to 1.2 g/cm³.

3. The silver halide photographic material of claim 1, wherein said dry-thickness of the emulsion layer is within the range of from 1.0 μm to 3.8 μm.

4. The silver halide photographic material of claim 1, wherein a silver halide grain comprised in said blue-sensitive emulsion layer is constructed by a core essentially consisting of silver bromide and/or silver iodobromide and a plurality of shells essentially consisting of silver bromide and/or silver iodobromide provided on said core, provided that a content of silver iodide of the outermost shell is not more than 10 mol% and a silver iodide content of a shell provided inside of said outermost shell is not less than 6 mol% higher than that of said outermost shell.

5. The silver halide photographic material in claim 1, wherein said emulsion layer contains an acylacetoanilide-type yellow coupler.

6. The silver halide photographic material of claim 5, wherein said acylacetoanilide-type yellow coupler is a benzoylacetoanilide-type yellow couplers.

7. The silver halide photographic material of claim 5, wherein said acylacetoanilide-type yellow coupler is a pivaloylacetoanilide-type yellow couplers.

8. The silver halide photographic material of claim 5, 7, wherein a content of said yellow coupler in said emulsion layer is from 0.1 to 30 moles per mole of silver contained therein.

9. The silver halide photographic material of claim 1, wherein said blue-sentitive silver halide emulsion layer contains a high speed reactive scavenger of which relative reaction rate is not less than 1.6 and not more than 15.0.

10. The silver halide photographic material of claim 1, wherein said silver halide photographic material further comprises a non-photosensitive layer adjacently provided with said blue-sensitive emulsion layer.

11. The silver halide photographic material of claim 10, wherein at least one of said layers, the blue-sensitive emulsion layer, and the non-photosensitive layer, contains said scavenger.

12. The silver halide photographic material of claim 9, wherein said scavenger is selected from the compounds represented the general formula [I] to [V]:

General Formula [I]

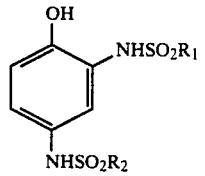

wherein $R_1$ and $R_2$ is independently selected from an aryl group and an alkyl group, General Formula [II]

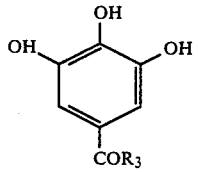

wherein $R_3$ is selected from —OR′ and —NHR′ and R′ is selected from an aryl group and an alkyl group, General Formula [III]

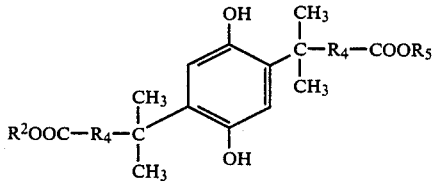

wherein $R_4$ is an alkylene group and $R_5$ is selected from an alkyl group and an aryl group, General Formula [IV]

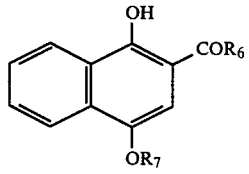

wherein $R_6$ is selected from

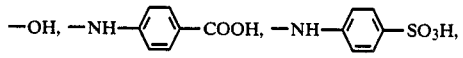

and —$NH(CH_2)_2COOH$ and $R_7$ is selected from an alkyl group and an aryl group, General Formula [V]

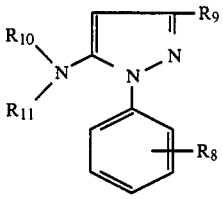

wherein $R_8$ is selected from a hydrogen atom, a halogen atom, a sulfo group and acylamino group, $R_9$ is selected from an alkyl group and an alkoxy group and $R_{10}$ and $R_{11}$ are an alkyl group.

13. The silver halide photographic material of claim 6, wherein a content of said yellow coupler in said emulsion layer is from 0.1 to 30 moles per mole of silver contained therein.

14. The silver halide photographic material of claim 7, wherein a content of said yellow coupler in said emulsion layer is from 0.1 to 30 moles per mole of silver contained therein.

15. The silver halide photographic material of claim 9, wherein said scavenger is selected from the compounds represented the general formula [I] to [V]:

General Formula [I]

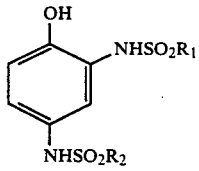

wherein $R_1$ and $R_2$ is independently selected from an aryl group and an alkyl group, General Formula [II]

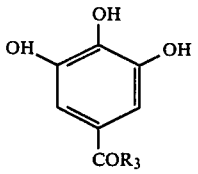

wherein $R_3$ is selected from —OR′ and —NHR′ and R′ is selected from an aryl group and an alkyl group, General Formula [III]

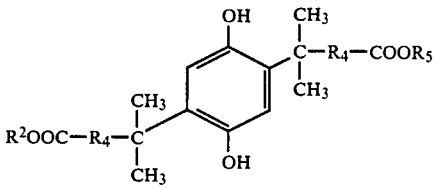

wherein $R_4$ is an alkylene group and $R_5$ is selected from an alkyl group and an aryl group, General Formula [IV]

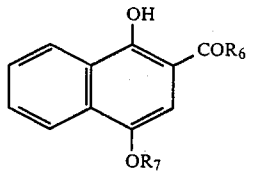

wherein $R_6$ is selected from

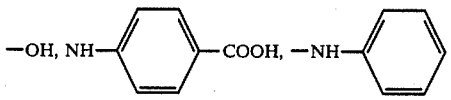

$-SO_3H$, and $-NH(CH_2)_2COOH$ and $R_7$ is selected from a alkyl group and an aryl group, General Formula [V]

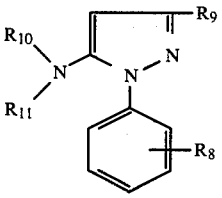

wherein $R_8$ is selected from a hydrogen atom, a halogen atom, a sulfo group and acylamino group, $R_9$ is selected from an alkyl group and an alkoxy group and $R_{10}$ and $R_{11}$ are alkyl group.

16. The silver halide photographic material of claim 11, wherein said scavenger is selected from the compounds represented the general formula [I] to [V]:

General Formula [I]

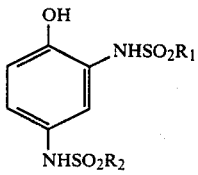

wherein $R_1$ and $R_2$ is independently selected from an aryl group and an alkyl group, General Formula [II]

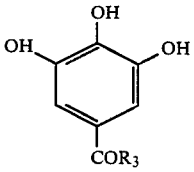

wherein $R_3$ is seclected from $-OR'$ and $-NHR'$ and $R'$ is selected from an aryl group and an alkyl group, General Formula [III]

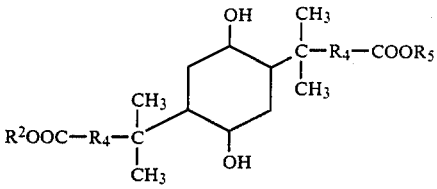

wherein $R_4$ is an alkylene group and $R_5$ is selected from an alkyl group and an aryl group, General Formula [IV]

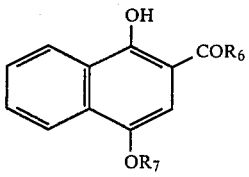

wherein $R_6$ is selected from

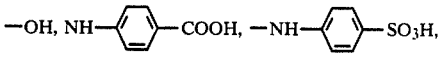

and $-NH(CH_2)_2COOH$ and $R_7$ is selected from an alkyl group and an aryl group, General Formula [V]

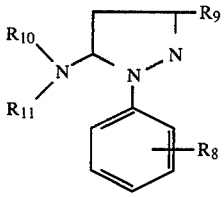

wherein $R_8$ is selected from a hydrogen atom, a halogen atom, a sulfo group and acylamino group, $R_9$ is selected from an alkyl group and an alkoxy group and $R_{10}$ and $R_{11}$ are alkyl group.

17. The silver halide photographic material of claim 11 wherein said scavenger is selected from the compounds represented by the general formula [I] to [V]:

General Formula [I]

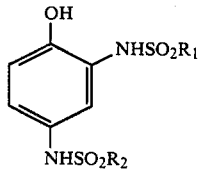

wherein $R_1$ and $R_2$ is independently selected from an aryl group and an alkyl group, General Formula [II]

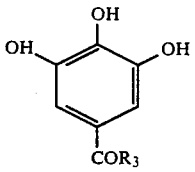

wherein $R_3$ is selected from —OR′ and —NHR′ and R′ is selected from an aryl group and an alkyl group, General Formula [III]

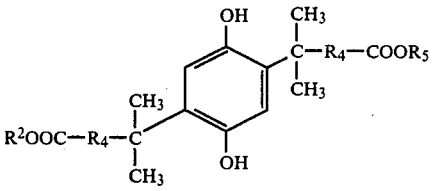

wherein $R_4$ is an alkylene group and $R_5$ is selected from an alkyl group and an aryl group, General Formula [IV]

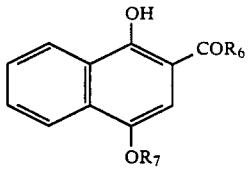

wherein $R_6$ is selected from

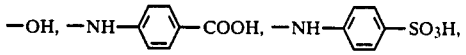

and $—NH(CH_2)_2COOH$ and $R_7$ is selected from an alkyl group and an aryl group, General Formula [V]

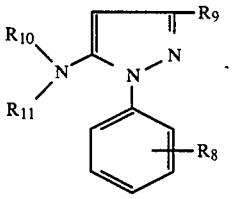

wherein $R_8$ is selected from a hydrogen atom, a halogen atom, a sulfo group and acylamino group, $R_9$ is selected from an alkyl group and an alkoxy group and $R_{10}$ and $R_{11}$ are an alkyl group.

* * * * *